US009045710B2

(12) United States Patent
Green et al.

(10) Patent No.: US 9,045,710 B2
(45) Date of Patent: Jun. 2, 2015

(54) ELECTRORHEOLOGICAL FLUIDS AND METHODS

(75) Inventors: Peter F. Green, Ann Arbor, MI (US); Ernest C. McIntyre, Ypsilanti, MI (US)

(73) Assignee: The Regents of The University of Michigan, Ann Arbor, MI (US)

( * ) Notice: Subject to any disclaimer, the term of this patent is extended or adjusted under 35 U.S.C. 154(b) by 512 days.

(21) Appl. No.: 13/441,734

(22) Filed: Apr. 6, 2012

(65) Prior Publication Data

US 2012/0256135 A1 Oct. 11, 2012

Related U.S. Application Data

(60) Provisional application No. 61/473,443, filed on Apr. 8, 2011.

(51) Int. Cl.

| | |
|---|---|
| ***C10M 111/04*** | (2006.01) |
| ***C10M 111/02*** | (2006.01) |
| ***C10M 139/00*** | (2006.01) |
| ***C10M 171/00*** | (2006.01) |

(52) U.S. Cl.

CPC ..... *C10M 139/00* (2013.01); *C10M 171/001* (2013.01); *C10M 2203/1006* (2013.01); *C10M 2203/1025* (2013.01); *C10M 2205/04* (2013.01); *C10M 2229/025* (2013.01); *C10M 2229/04* (2013.01); *C10M 2229/041* (2013.01); *C10M 2229/0415* (2013.01); *C10N 2230/60* (2013.01); *C10N 2250/12* (2013.01); *C10N 2260/10* (2013.01); *C10M 2229/053* (2013.01); *C10M 2229/0535* (2013.01)

(58) Field of Classification Search

CPC ..... H01B 1/12; H01B 1/24; C07F 7/21; C10M 171/00; C10M 171/001; C10M 111/04; C10M 111/02

USPC ..... 252/73

See application file for complete search history.

(56) References Cited

U.S. PATENT DOCUMENTS

| | | | | |
|---|---|---|---|---|
| 3,576,294 | A * | 4/1971 | Baldwin | 239/101 |
| 5,364,565 | A * | 11/1994 | Li | 252/500 |
| 5,558,803 | A * | 9/1996 | Okada et al. | 252/78.3 |
| 2009/0250652 | A1 * | 10/2009 | Uebe et al. | 252/62.54 |

OTHER PUBLICATIONS

McIntyre et al., Applied Materials & Interfaces, vol. 2, No. 4, 965-968, published Apr. 12, 2010.*

(Continued)

*Primary Examiner* — Jane L Stanley

(74) *Attorney, Agent, or Firm* — Harness, Dickey & Pierce, P.L.C.

(57) ABSTRACT

Electrorheological fluids and methods include changes in liquid-like materials that can flow like milk and subsequently form solid-like structures under applied electric fields; e.g., about 1 kV/mm. Such fluids can be used in various ways as smart suspensions, including uses in automotive, defense, and civil engineering applications. Electrorheological fluids and methods include one or more polar molecule substituted polyhedral silsesquioxanes (e.g., sulfonated polyhedral silsesquioxanes) and one or more oils (e.g., silicone oil), where the fluid can be subjected to an electric field.

30 Claims, 23 Drawing Sheets

Figure 1:
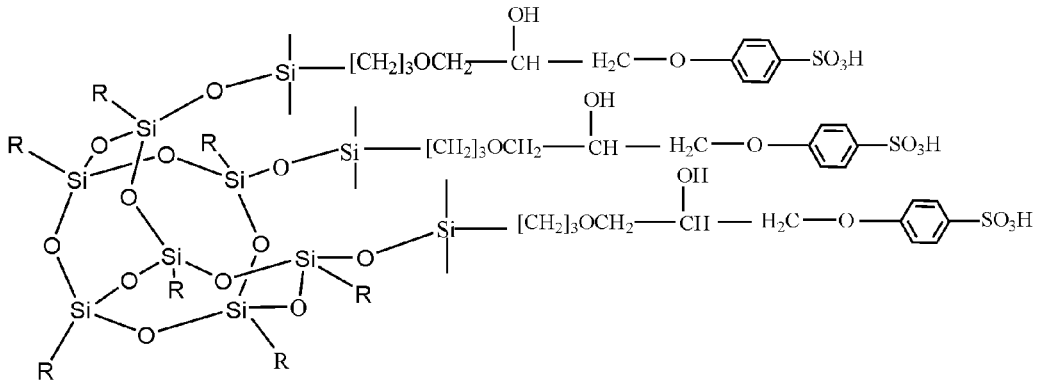

OH
Si
[CH2]3OCH2
CH
H2C
O
SO3H
R
O
Si
O
R
Si
O
Si
O
Si
O

(56) References Cited

OTHER PUBLICATIONS

McIntyre et al., Applied Materials & Interfaces, 5, 8925-8931, published Aug. 26, 2013.*

McIntyre et al., Applied Materials & Interfaces, 4, 2148-2153, published Mar. 19, 2012.*

Marins et al., Materials Science and Engineering C, 33, 133-139, published Aug. 21, 2012.*

* cited by examiner (c)

(a)

(b)

(c)

(a)

(b)

(a)

(b)

(c)

| | ε0 | ε∞ | Δε | τ | α |
|---|---|---|---|---|---|
| PS1 | 2.72 | 3.14 | 0.42 | 0.097 | 0.64 |
| PS2 | 2.73 | 3.37 | 0.64 | 0.299 | 0.62 |
| PS3 | 2.66 | 3.58 | 0.92 | 0.868 | 0.66 |

ELECTRORHEOLOGICAL FLUIDS AND METHODS

CROSS REFERENCE TO RELATED APPLICATIONS

This application claims the benefit of U.S. provisional application 61/473,443, filed Apr. 8, 2011, the entire disclosure of which is hereby incorporated by reference.

GOVERNMENT RIGHTS

This invention was made with U.S. Government support under DE-FG02-07ER46412 awarded by the Department of Energy. The U.S. Government has certain rights in the invention.

FIELD

The present technology relates to electrorhelological fluids, compositions and formulations thereof, and methods of using and modifying properties of such fluids.

INTRODUCTION

Rheological properties, such as the viscosity and the shear modulus, of electrorheological (ER) fluids can undergo reversible change by orders of magnitude under the influence of an applied electric field, E. The viscosities, $\eta$, and yield stresses, $\sigma$ of conventional ER fluids, composed of non-conducting, semiconducting, inorganic particles, with average sizes of order microns, suspended in a non-conducting liquid, such as silicone oil paraffin or mineral oil, increase by factors of $10^2$-$10^3$ under the influence of fields E~1 kV/mm. Other systems, suspensions of conjugated polymers, surfactants, polyelectrolytes or liquid crystal polymers, in oil are also known to exhibit ER behavior.

The conventional ER effect is associated with the notion that the particles undergo an electric field induced polarization. Specifically, during the initial stage of the ER effect, which occurs in milliseconds, chains of particles are formed between the electrodes, due to induced-dipole/induced-dipole interactions between the particles. Subsequently columns of particles develop, via a coarsening mechanism; this occurs on time-scales on the order of many seconds. One important characteristic of the conventional ER fluids is that, according to theory, the interaction forces between the particles, and hence the shear stresses, $\tau$, exerted at the electrodes, scale as $\tau \propto E^2D^2$, where D is the particle diameter.

Nanoparticle based systems have generally not been promising; they exhibit effects that are weaker than conventional ER fluids. However, in 2003, a core-shell nanoparticle system, composed of barium titanyl oxalate particles (50-70 nm) coated with urea (~10 nm) mixed with silicone oil, was found to show considerable promise. This system exhibited stresses larger than 100 kPa, approximately two orders of magnitude greater than that exhibited by conventional ER fluids. This has come to be known as the giant electrorheological (GER) effect. Several other core-shell systems, including urea coated $TiO_2$, Ca—Ti—O, and Sr—Ti—O particles, have been shown to exhibit similar behavior. A theory is based on the notion that because the particles possess permanent dipole moments, then $\tau \propto E/D$, where D is the particle diameter. This prediction indicates that, in contrast to conventional ER fluids, the stress scales as E and the effect increases with decreasing particle size.

An important drawback, for some applications, would be unacceptably large viscosities in the absence of applied fields, exhibited by these solid particle based ER fluids. These large viscosities are associated with the significant concentrations, on the order of 30%, of the suspended particle-rich phases in ER fluids. Moreover, the GER zero field viscosities are larger than those of the conventional ER suspensions. Consequently, it is important to identify a fluid which would exhibit a large ER effect, at least comparable to the conventional ER systems, which possess low zero shear viscosities in the absence of an electric field, and comparable to the viscosity of silicone oil. Such a system would facilitate easier processing and utilization, particularly in microfluidic applications.

SUMMARY

The present technology includes systems, methods, articles, and compositions that relate to electrorheological fluids, including an amphiphile dispersed or suspended in an oil. In various embodiments, the fluids further contain suspended particles of a polymeric material that enhances the ER effect. In one embodiment, an ER fluid is a suspension of a sulfonated polyhedral silsesquioxanes in silicone oil.

In exemplary fashion, mixtures of an amphiphile such as sulfonated polyhedral silsesquioxane cage structures (sPOSS) and poly(dimethyl siloxane) (PDMS), silicone oil are provided that exhibit significant electrorheological (ER) activity. At low sPOSS concentrations (e.g., less than 10% wt.), the viscosity can be enhanced by about 100-fold, which is comparable to the viscosity enhancements exhibited by conventional ER fluids, under the influence of comparable applied electric fields, E=2 kV/mm. Measurements of the shear stress, $\sigma$, dependencies on E, the conductivities and relative permittivities, reveal that the properties of these POSS/PDMS systems cannot be reconciled with theory developed to explain the behavior of conventional ER fluids.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1. General chemical structures for TSA(R)-POSS open cage structures. R=ethyl for tris sulfonic acid ethyl (TSAE)-POSS.

FIG. 2. TSA(E) POSS step rate test shear rate=0.5 $s^{-1}$ (taken at the rim where it is maximum), voltage turned on after 60 seconds and then turned off after 60 seconds: (a) DC Voltage (2 kV/mm), inset plot shows values for current density at a rate of 0.5 $s^{-1}$ for sample sheared at a rate from 30 $s^{-1}$ down to 0.1 $s^{-1}$; (b) AC Voltage (1 kHz, 2 kV/mm); (c) 10% wt. octa-isobutyl POSS DC Voltage (2 kV/mm)

Figure 3:
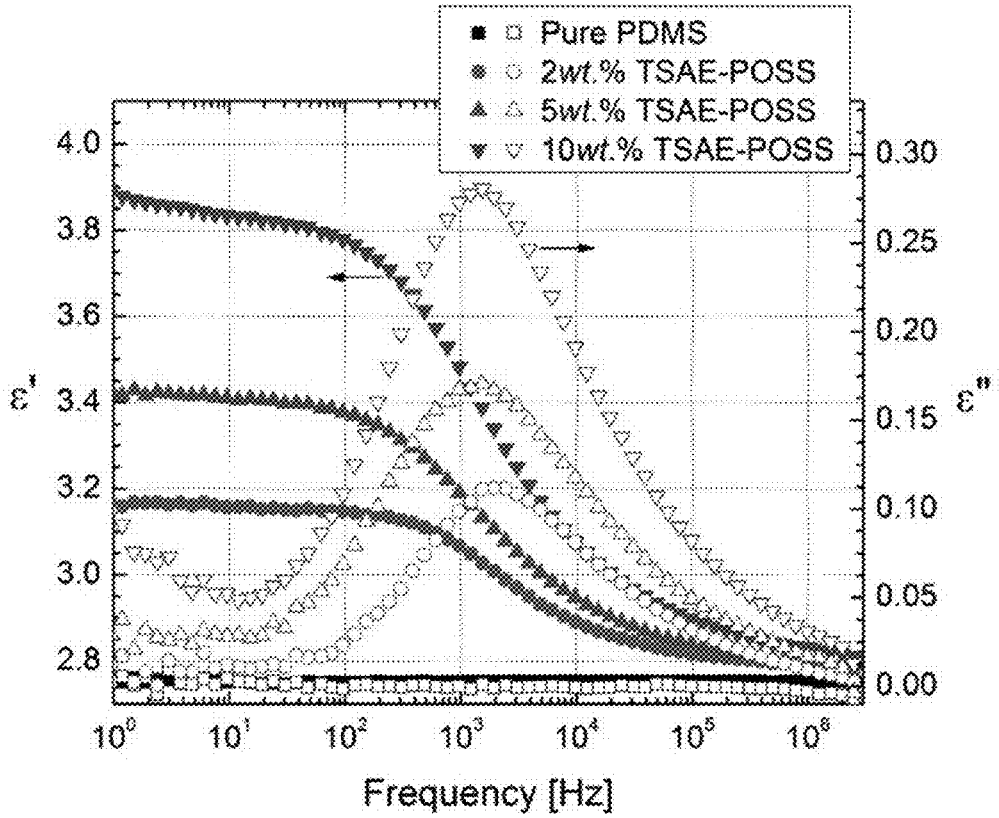

FIG. 3. Frequency dependencies for the real and imaginative relative permittivities for the mixtures on the left and the right, respectively.

Figure 4:
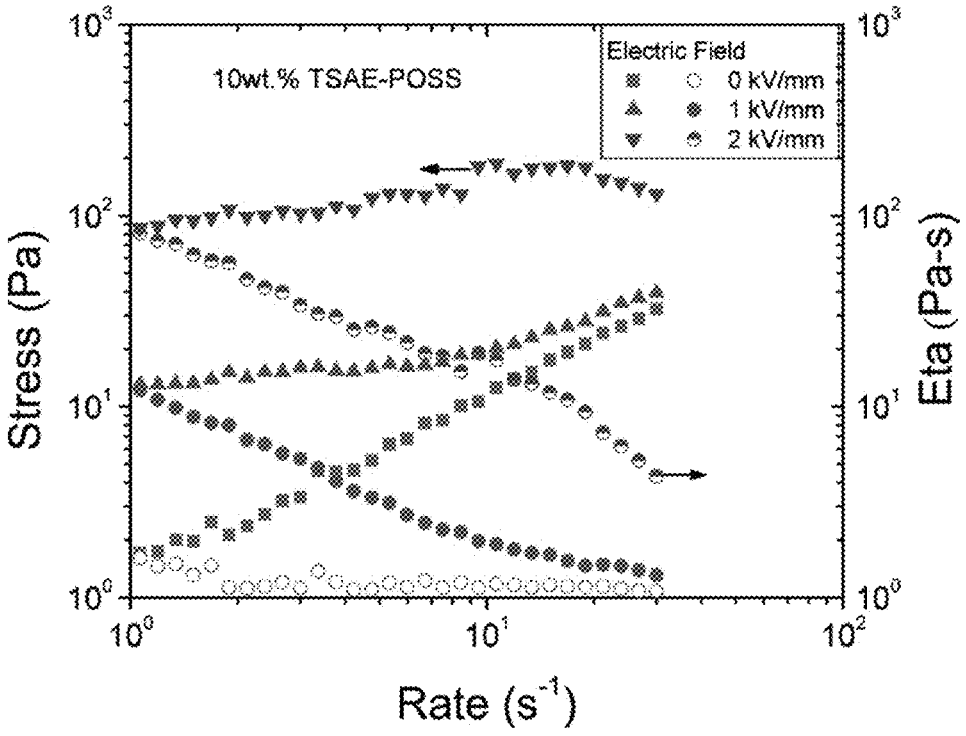

FIG. 4. Steady rate sweep 10% wt. TSA(E) POSS in silicone oil.

Figure 5:
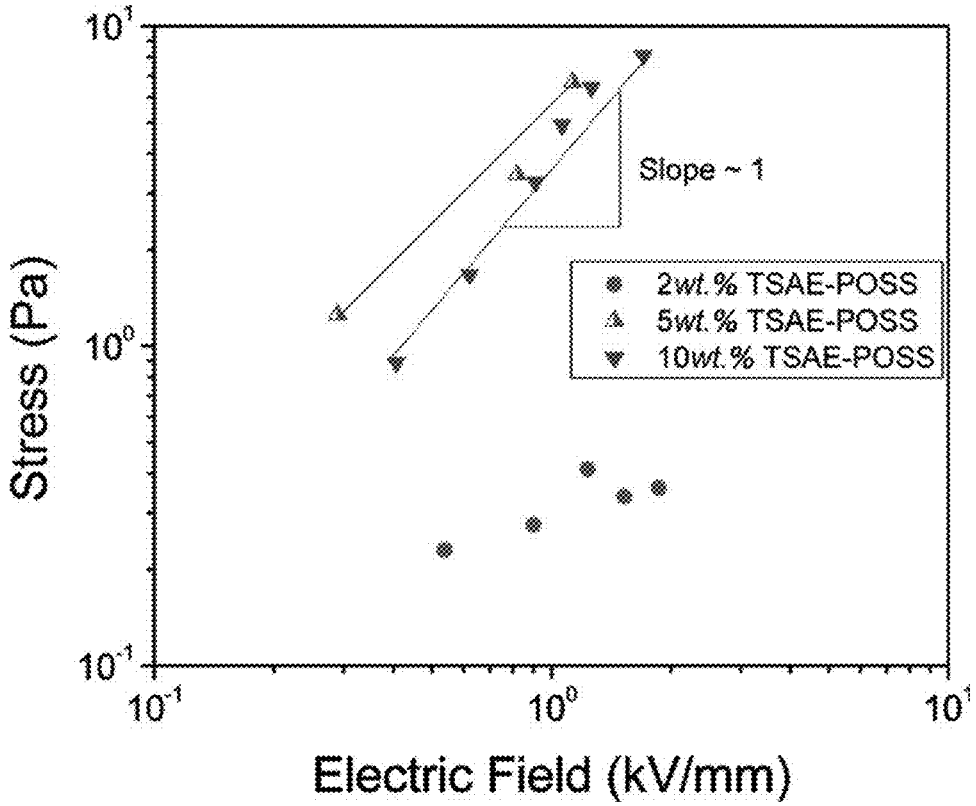

FIG. 5. Stress as a function of electric field at low shear rate (0.1 $s^{-1}$) (taken at the rim where it is maximum) as the electric field is increased for sulfonated POSS/PDMS mixture at 10% wt in order to approximate stress behavior in the pre-yield regime. Time between measurements was 45 s.

Figure 6:
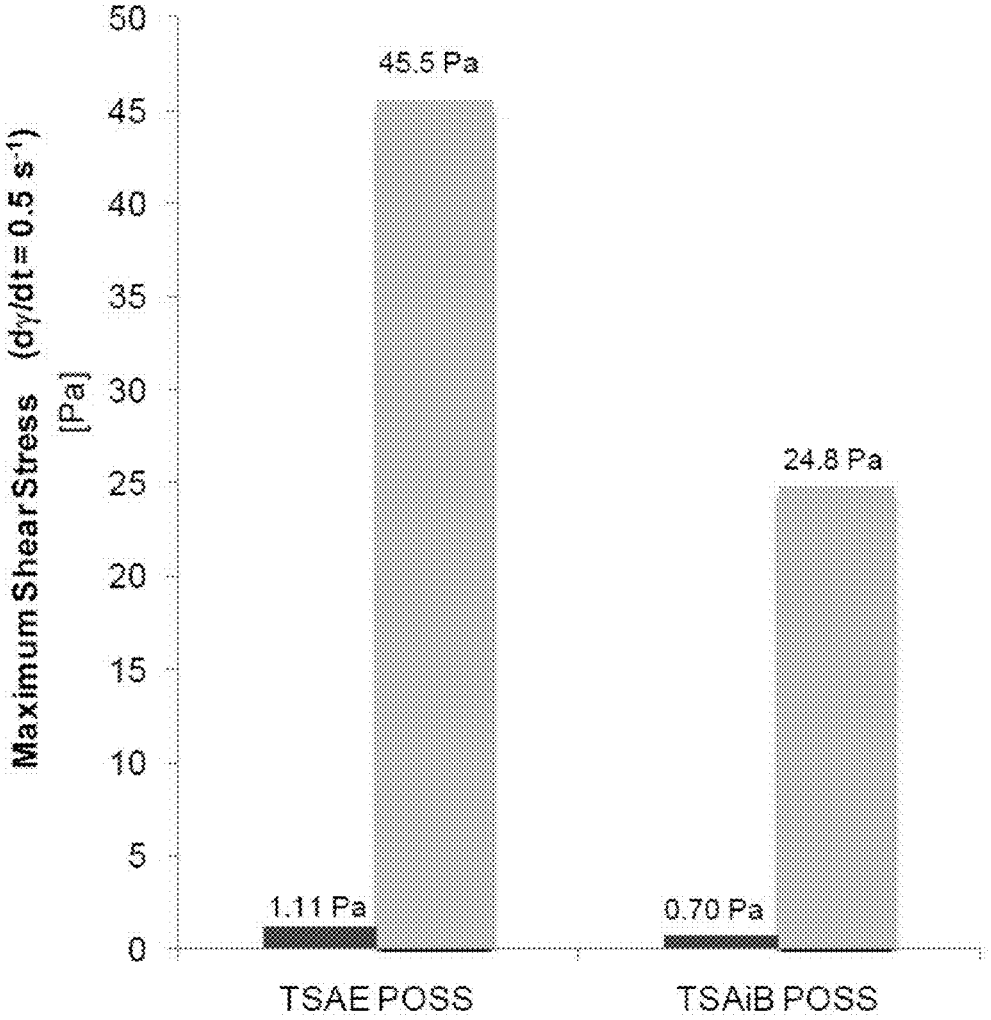

FIG. 6. Maximum Shear Stress for 10% wt. Suspension Constant Shear Rate Measurements ($d\gamma/dt=0.5\ s^{-1}$) over a period of 60 s without applied electric field (dark) and with 2.0 kV/mm field (light).

Figure 7A:
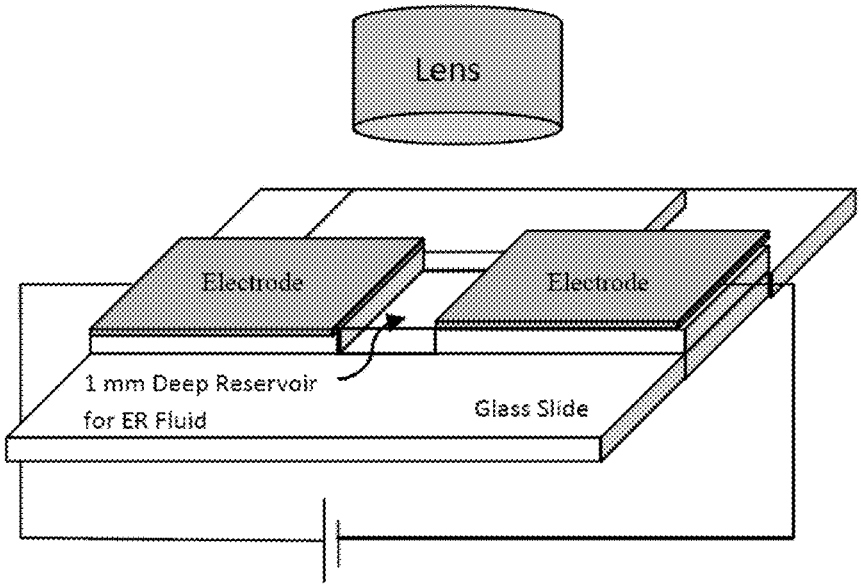
Figure 7B:
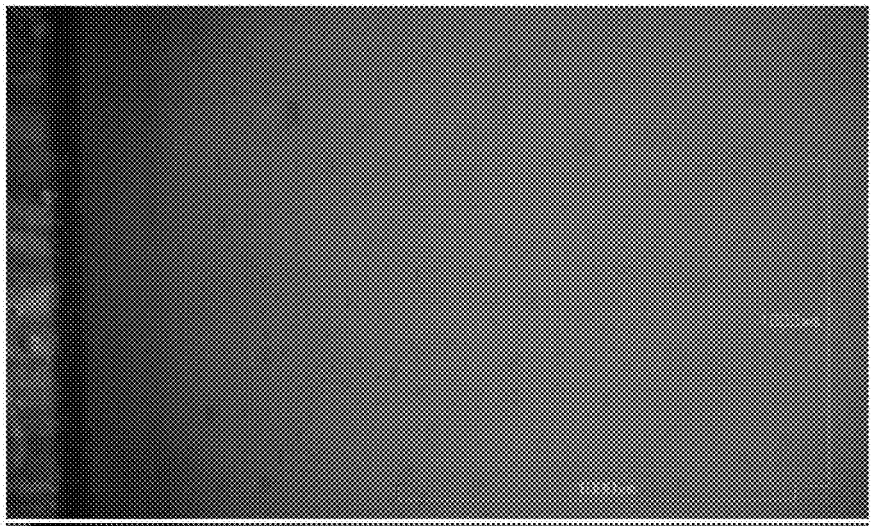

FIG. 7. (a) Experimental arrangement: 2.9 mm Channel Width and 3.5 mm gap between electrodes (razors) (b) Optical Micrograph of 2% wt. TSAiB POSS/PDMS fluid confined between two electrodes is shown. The small circular structures represent aggregates of POSS molecules in the PDMS. (c) When an E=4.0 kV field is applied these structures form large columnar meso-phases that span the length of the electrodes. One of these columnar structures is shown here.

Figure 8:
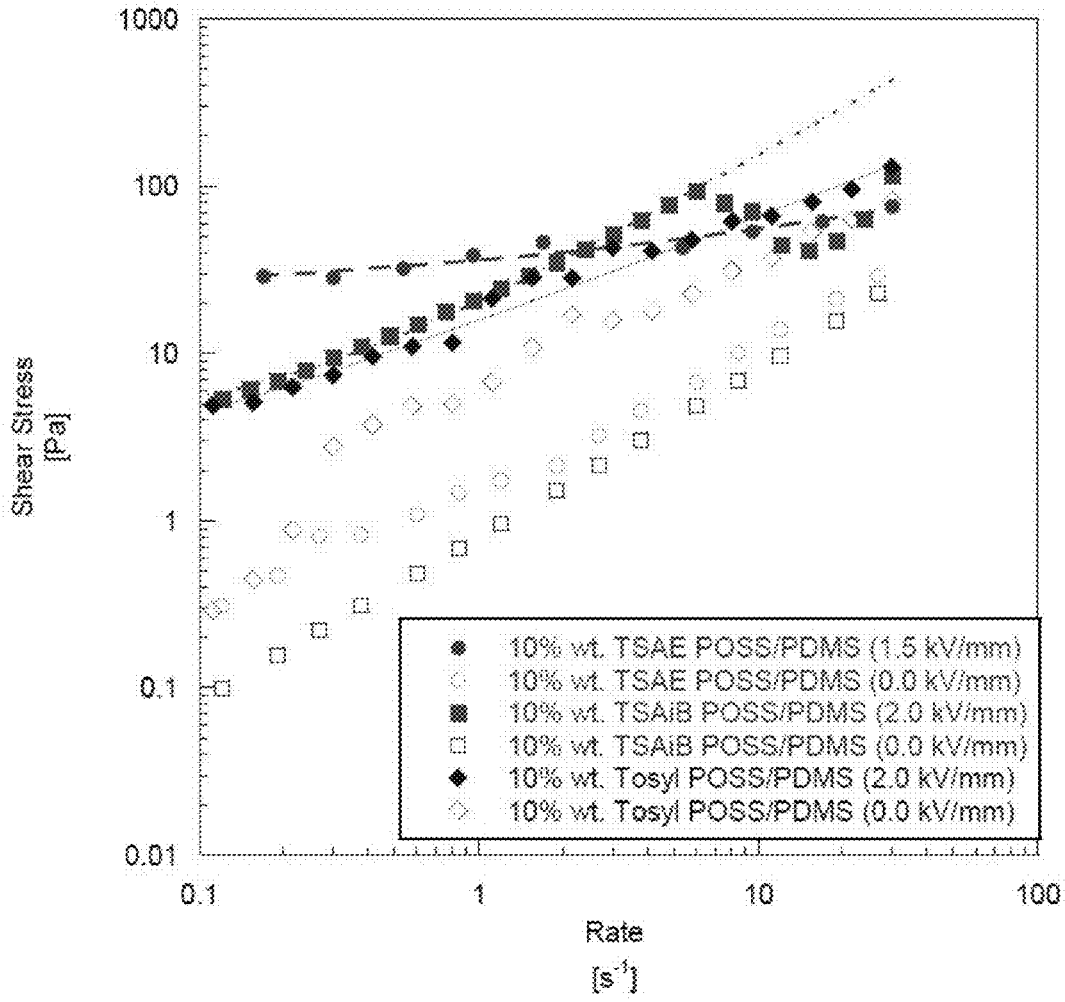

FIG. 8. Shear Stress vs. Shear Strain Rate for 10% wt. Amphiphile POSS Suspensions with Electric Field (Solid) and with no applied Electric Field (Open). The lines correspond to fitting the Herschel Bulkley Model.

Figure 9:
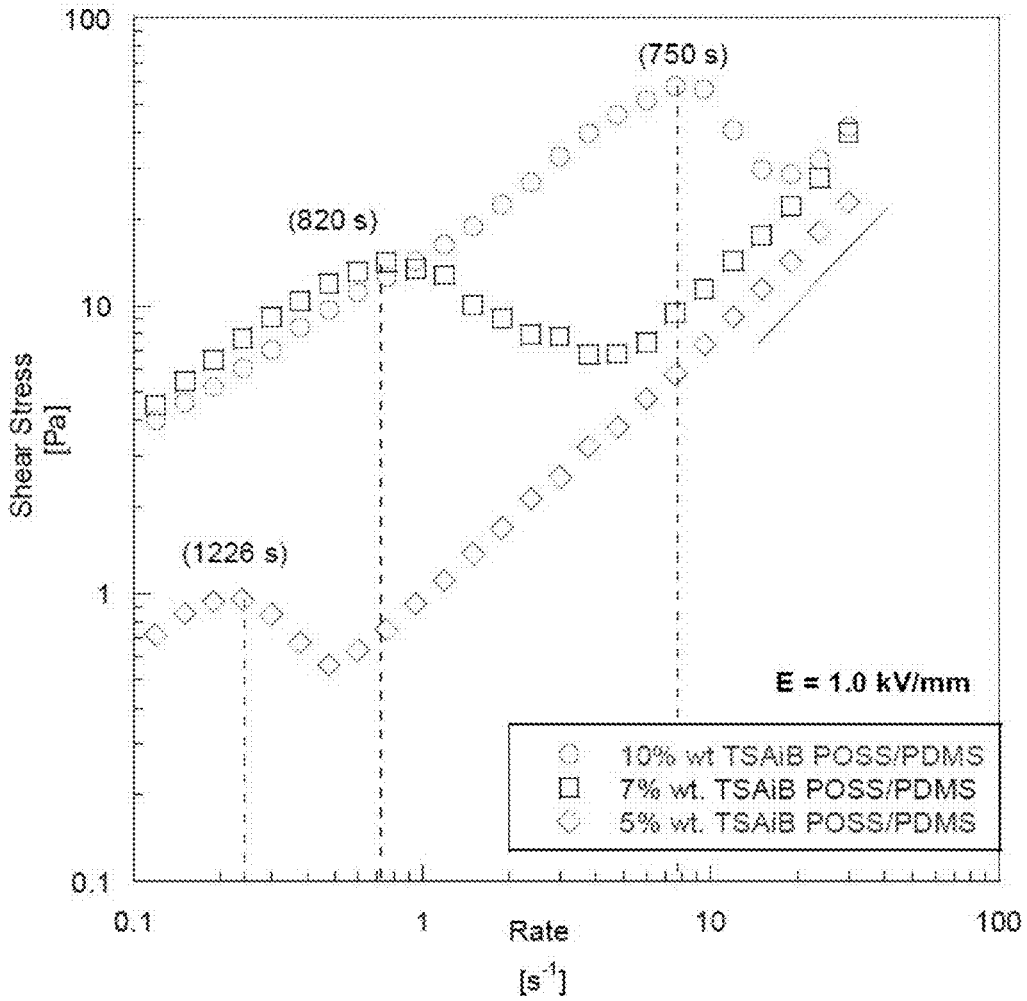

FIG. 9. Shear Stress vs. Shear Strain Rate for different concentrations of TSAiB POSS/PDMS.

FIG. 10. (a) Relative permittivity ($\in'$) vs. Frequency (b) Dielectric Loss ($\in''$) vs. Frequency for Different Concentrations Amphiphile POSS Suspensions.

Figure 11:
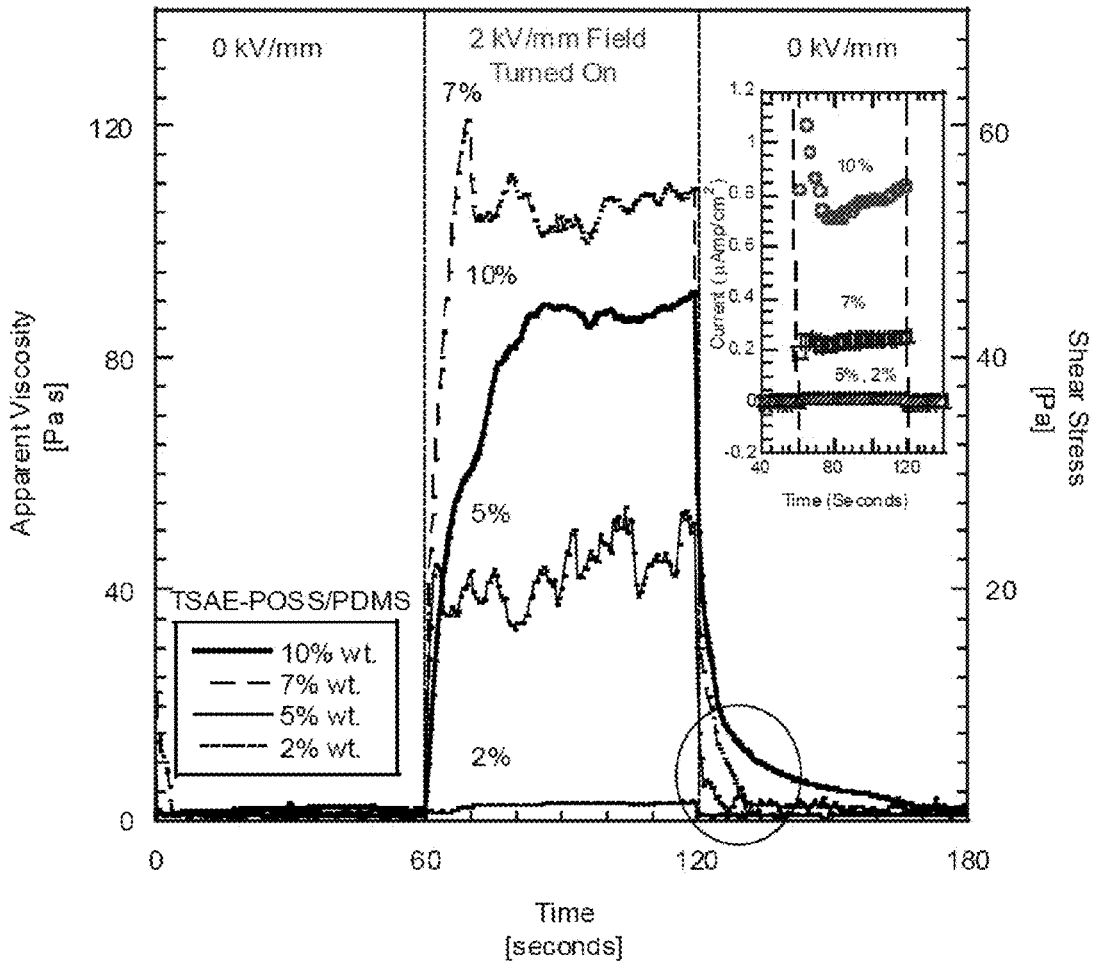

FIG. 11. Transient Constant Shear Rate Experiment for TSAE POSS/PDMS at different concentrations. The electric field is applied at 60 s and removed at 120 s.

Figure 12A:
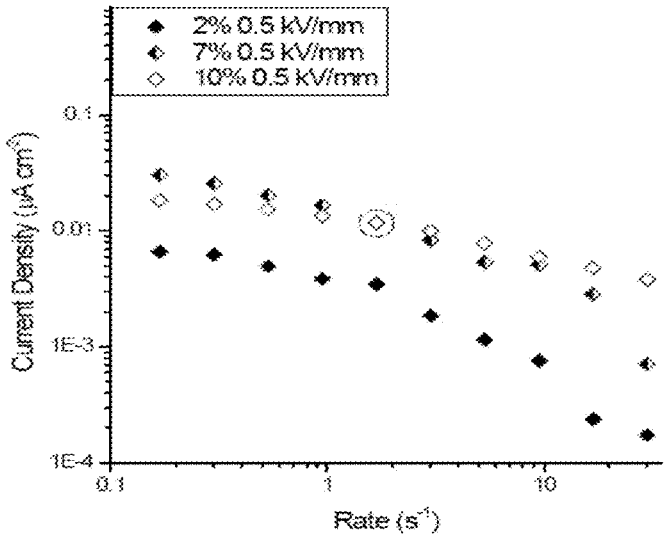
Figure 12B:
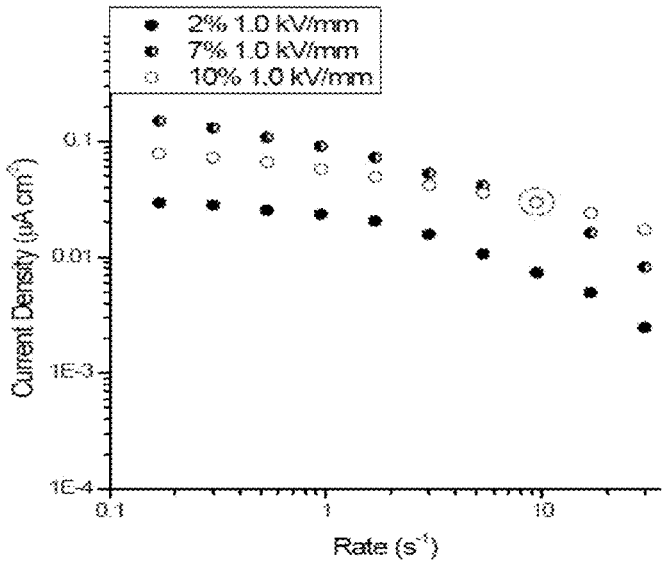
Figure 12C:
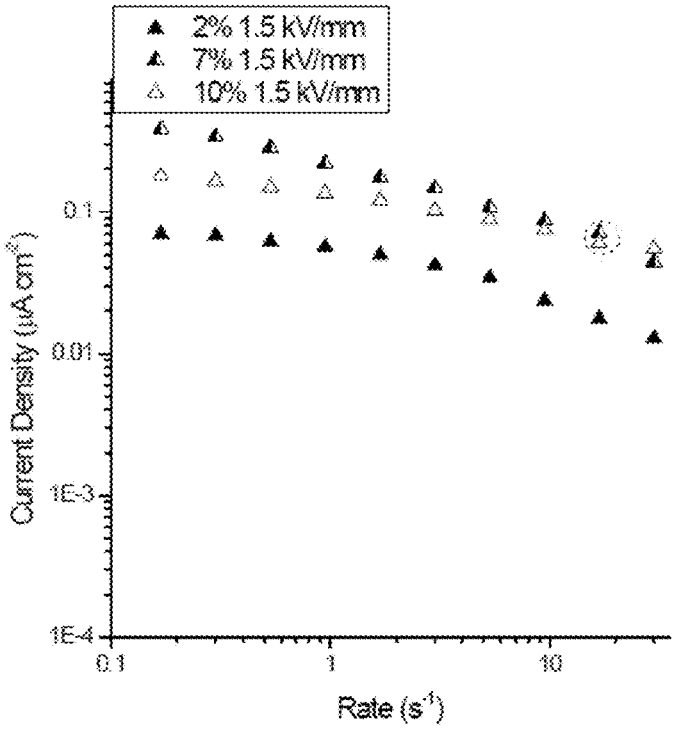

FIG. 12. Current Density vs. Shear Rate during a Steady Shear Rate Sweep for TSAE POSS/PDMS at 2% wt., 7% wt., and 10% wt. at (a) 500 V/mm (b) 1000 V/mm and (c) 1500 V/mm FIG. 13: Electrorheological Effect (Apparent Viscosity/Viscosity at Zero Electric Field) vs. Shear Stress plot for 10% wt. POSS electrolytes mixed with PDMS (Circles) compared to 1% wt. TSAiB-POSS mixed with 10% wt. PS/PDMS (Squares). The brackets in the figure denote the electric field in units of kV/mm.

Figure 14:
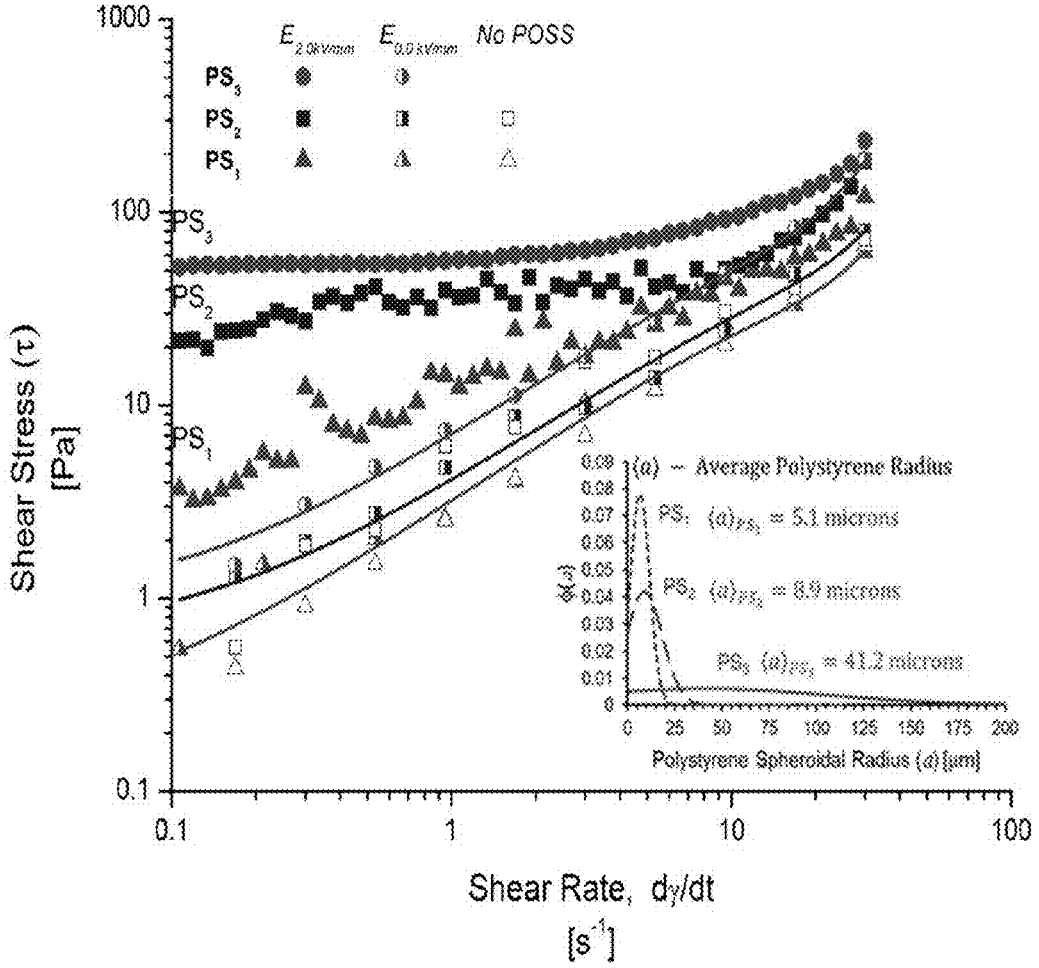

FIG. 14: The shear stress is plotted as a function of shear rate for three different size polydisperse polystyrene powders mixed with 89% wt. PDMS and 1% wt. POSS electrolyte. Lines are drawn as guides to the eyes. The inset shows the normal distribution of particle sizes, measured by optical microscopy (Sample Size, N=350, 650, 3100 for PS3, PS2 and PS1 respectively).

Figure 15:
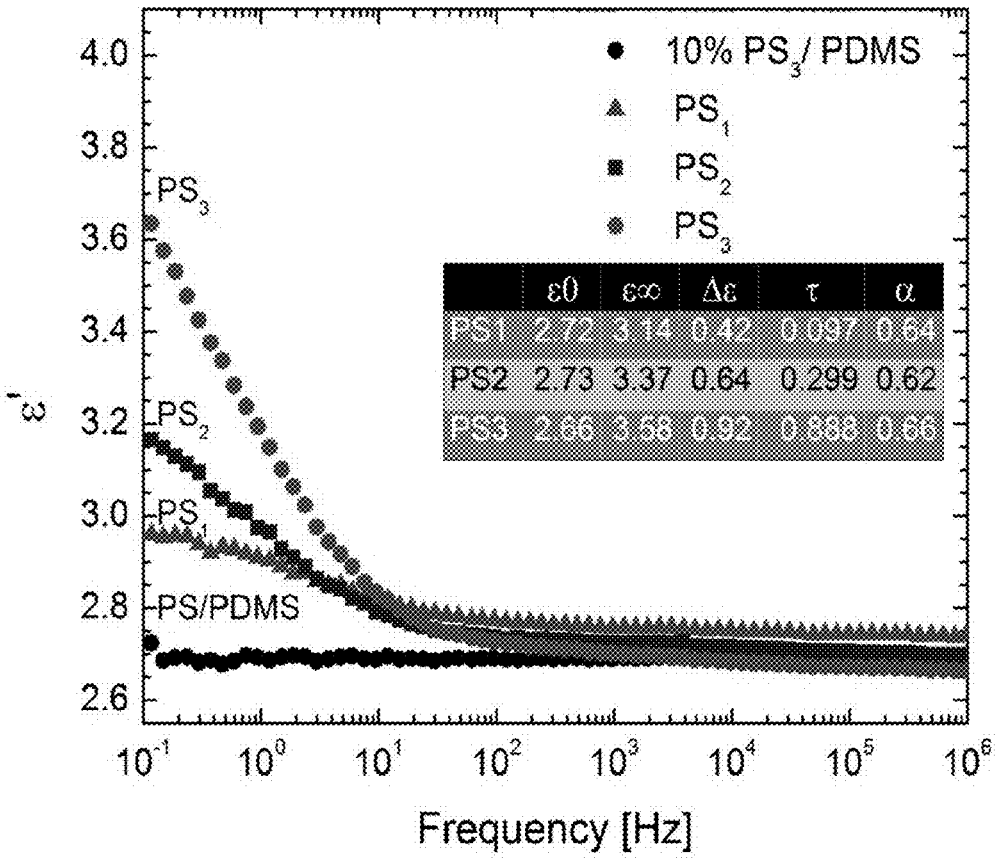

FIG. 15: Real dielectric constants for 1% TSAiB POSS/10% wt. Polystyrene/PDMS FIG. 16 imaginary dielectric constants for 1% wt. TSAiB POSS/10% wt. Polystyrene/PDMS. Inset is SEM images of the PS powder with 50 μm scale bar.

Figure 17:
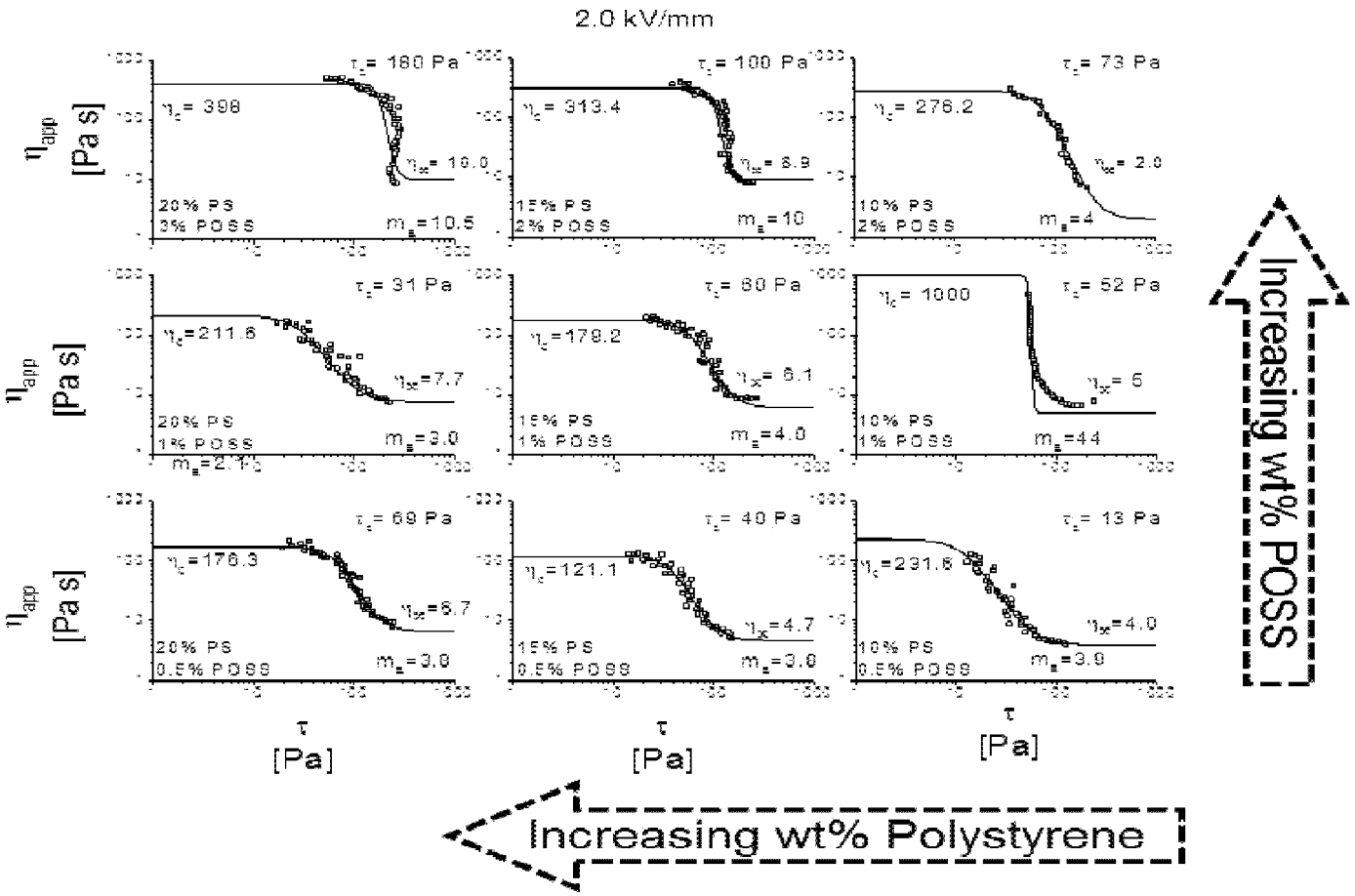

FIG. 17: Apparent Viscosity ($\eta_{app}$) vs. Shear Stress ($\tau$) for different compositions of TSAiB POSS/PS/PDMS prepared with average radius <a>=41.3 μm PS. The electric field is kept at 2.0 kV/mm. The lines are fits to the Ellis model, eqn. 4.

Figure 18:
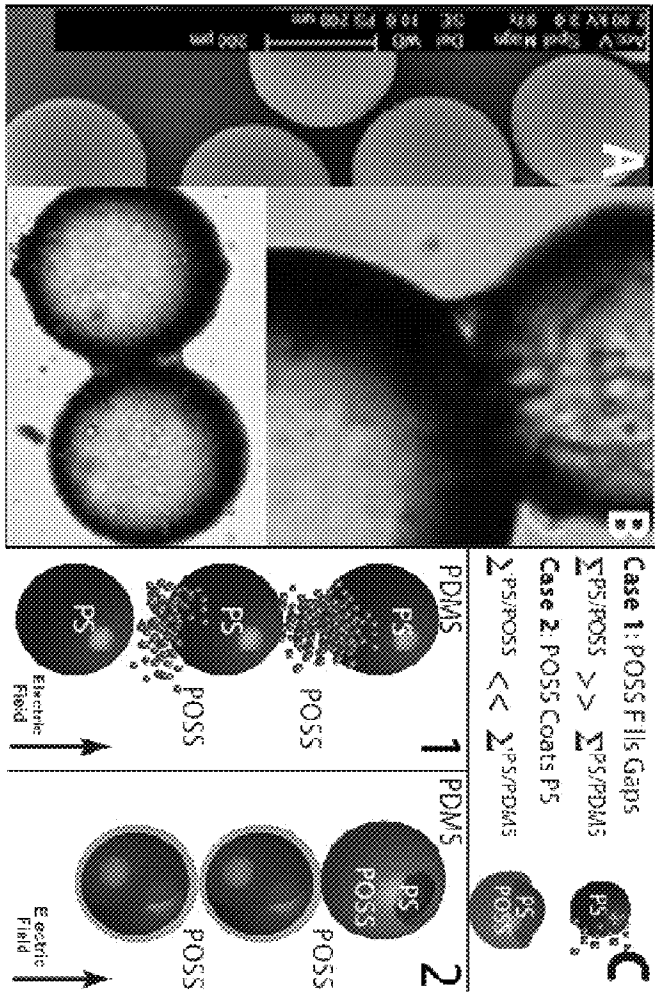

FIG. 18: (Far Left) (a) SEM Images of Different Size Polystyrene Microspheres. (a) Optical Microscope images of PS spheres after removal from the TSAiB POSS/PS/PDMS suspension following electrorheological testing. (c) Cartoon showing POSS additive with PS Microspheres (Left) Case 1 POSS Fills Gaps (Far Right) Case 2 POSS Coats PS.

Figure 19:
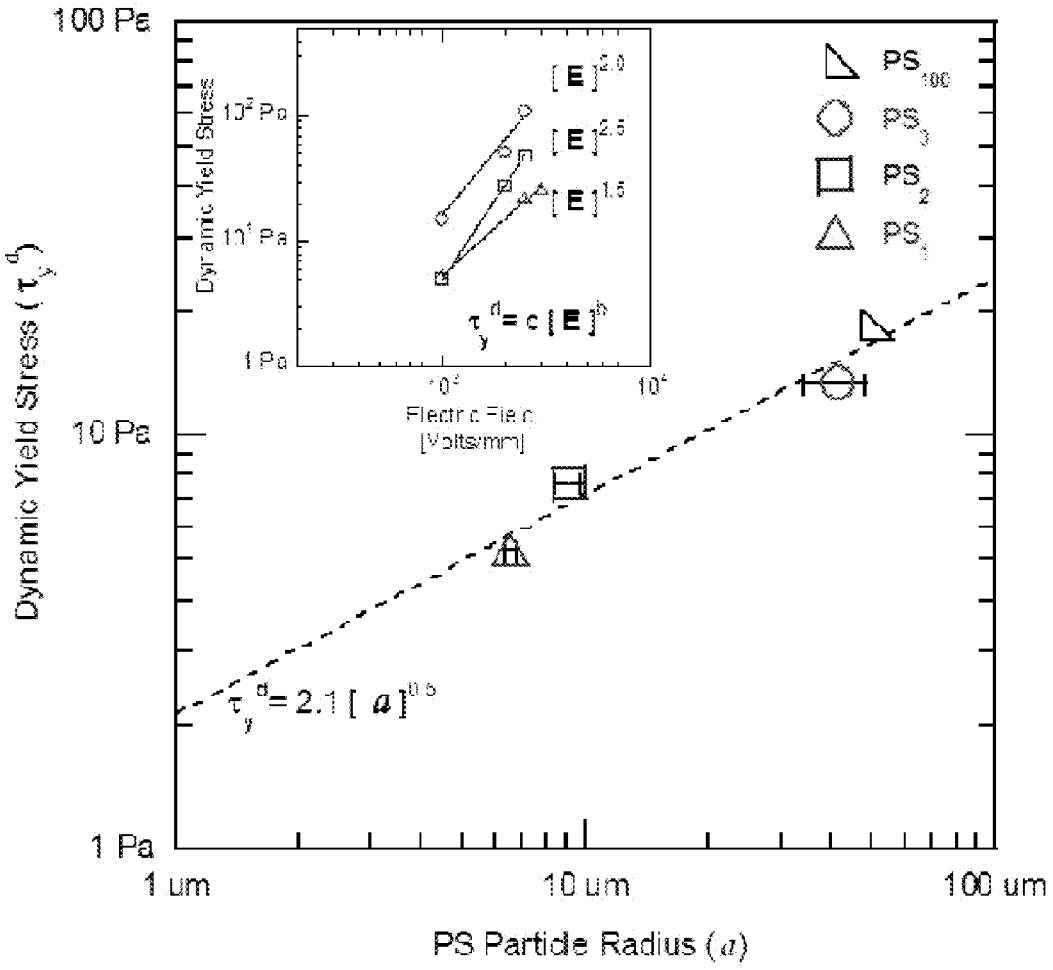

FIG. 19: Dynamic Yield Stress (Herschel Bulkley Model) as a function of particle radius (a) for 1% wt. TSAiB POSS/10% wt. PS/PDMS Suspensions at E=1 kV/mm. Least Squared Error Linear Fits for each electric field are shown. Horizontal Bars are for 95% Confidence Intervals on size based on the PSD from optical microscopy.

DETAILED DESCRIPTION

The present technology relates to electrorheological fluids, methods of making such fluids, and methods of using such fluids, including applying an electric field to such fluids to change their rheological properties.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. A non-limiting discussion of terms and phrases intended to aid understanding of the present technology is provided at the end of this Detailed Description.

In one embodiment, an ER fluid is constituted as a suspension of an amphiphile (further defined) in an oil. The oil has sufficient viscosity to maintain a suitably stable suspension, and in exemplary embodiments is a silicone oil, and especially a polydimethylsiloxane (PDMS). In some embodiments, the amphiphile is a polyhedral oligomeric silsesquioxane that is substituted with at least one polar group, wherein the amphiphile as a result has a permanent dipole. In various embodiments, the polyhedral oligomeric silsesquioxane is substituted with a single tosyloxypropyl group, with one to eight carboxyl groups, or with one to eight sulfonic acid groups. Further description of suitable amphiphiles is given below.

The ER fluid optionally contains an organic polymeric material that enhances the ER properties of the ER fluid. A non-limiting example of a polymeric material is polystyrene, which is present in the suspension as particles, for example particles of diameter 1 to 500 micrometers. In some embodiments, the particles of polymeric material are 50 nm-500 microns. Other suitable polymeric materials are described below.

In another embodiment, a two-component ER fluid of the invention is a suspension of a sulfonated siloxane cage compound in a polydimethylsiloxane oil (PDMS), with the suspension containing greater than 1% (v/v) and less than or equal to 30% (v/v) of the sulfonated silsesquioxane cage compound. A sulfonated polyhedral oligomeric silsesquioxane is a suitable cage compound. In various embodiments, the level of the cage compound or sulfonated polyhedral oligomeric silsesquioxane is 5-20% (v/v) or 5-10% (v/v). The volume to volume ratios are given for convenient guidance in formulating the fluids containing liquid ingredients without the need to weigh the components. Of course, equivalent weight ratios of the components can be obtained by calculation using the densities of the components.

In another particular embodiment, a three-component ER fluid is formulated as a suspension of a sulfonated siloxane cage compound (as an example of a suitable amphiphile) and a polymeric material in an oil. The suspension contains 0.1-10% by weight of the cage compound and 5-50% by weight of the polymeric material. Alternatively, the suspension contains 0.5-3% by weight of the cage compound and 5-30% by weight of the polymeric material. The polymeric material is present as suspended particles having a diameter of 1-500 micrometers, 3-100 micrometers, or 5-50 micrometers. In a preferred embodiment, the cage compound has sulfonic acid functionality. In one example, the structure of the cage compound is describable as a sulfonated polyhedral silsesquioxane.

The ER fluids of the current invention containing two components or three components, which are described separately below. It is to be understood that, unless the context requires otherwise, ER fluids can be formulated by mixing and matching various aspects of the description of the individual components, and using levels of components described for the various embodiments.

The two-component fluids contain an amphiphile and an oil. The three-component fluids further contain a polymeric material. The fluids are in the form of suspensions of relatively insoluble materials in one another. Because the oil is normally the component present in a major amount, and because the amphiphile and polymeric material can be provided in a solid form while the oil is generally liquid, the fluids are described as suspensions of amphiphile, and if present polymeric material, in the oil.

The Oil

The oil of the ER fluids is an inert hydrophobic material of suitable viscosity to support the formation of a stable suspension of the other components. A suspension is stable for the purposes of selecting an oil if it maintains its structure so as to be usable as an ER fluid. Non-limiting examples of oil include viscous hydrocarbons, silicone oil, mineral oil, and paraffin oil. In particular, polydimethylsiloxane is a suitable silicone oil.

The oil preferably makes up the balance, or most of the balance, of an ER fluid, once the other components are provided according to the compositional parameters discussed herein. Normally, that means that the fluids are greater than 50% (whether it is measured by weight or by volume) oil, and often greater than 60%, greater than 70%, or greater than 80%, again measured either by weight or by volume.

The Amphiphile

The amphiphile is present in two-component fluids typically at about 10% by weight, and in three-component fluids typically at about 1% by weight. Especially when the oil is a silicone, the amphiphile is a derivatized polysiloxane cage compound, wherein derivitization results in incorporation of a polar group. It is believed that the permanent dipole resulting from incorporation of the polar group contributes to the usefulness of the amphiphile in the ER fluid. Suitable polar groups include sulfonyl groups, sulfonic acid groups and carboxylic acid groups.

In various embodiments, the cage compound is based on a T8, T10, or T12 cage, which is siloxane chemistry short hand for silsesquioxanes containing 8, 10, or 12 silicon atoms, respectively. Because of their structure, certain of such cage compounds are known as polyhedral oligomeric silsesquioxanes, about which there is an extensive literature and many species of which are commercially available. For example, Hybrid Plastics sells a wide range of products under the POSS® trademark (from the industry term of "polyhedral oligomeric silsesquioxane"). As noted, preferred amphiphiles are substituted with polar groups in such a way that the molecule preferably exhibits a permanent dipole. In a preferred embodiment, the amphiphile has sulfonic acid groups and includes a sulfonated polyhedral oligomeric siloxane (abbreviated herein as "sPOSS" and not to be confused with the trademark POSS®). Suitable amphiphiles include cage compounds with three sulfonic acid groups, examples of which are given in Table 1. Species include those with the trivial names of TSAE POSS and TSAiB POSS, reflecting the tri-substituted cage compounds where R is ethyl and isobutyl respectively. The tosyloxypropyl (mono-substituted) cage compound is also provided as an illustration of a cage compound having a permanent dipole by incorporation of a sulfonyl group.

Table 1 illustrates sPOSS where R is ethyl or isobutyl. More generally, sPOSS are substituted with cycloalkyl or with C1-C10 alkyl, for example with C1-C4 alkyl, of which ethyl and isobutyl are two examples.

TABLE 1

POSS Chemical Structures

| POSS Chemical Structure | Chemical Name |
|---|---|
| 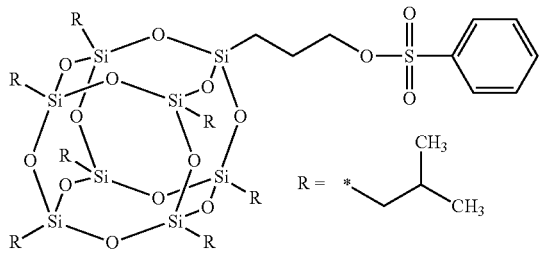 | Tosyloxypropyl heptaisobutyl POSS (Tosyl POSS) |
| 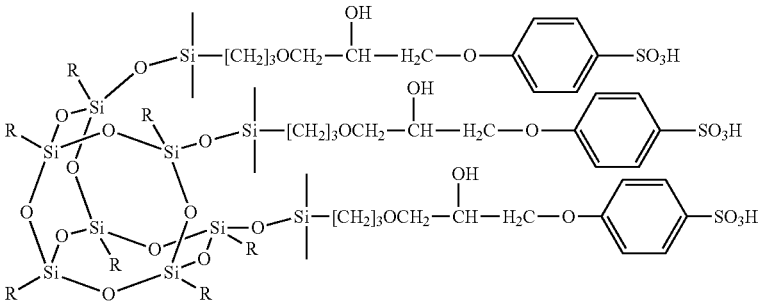 | Tris Sulfonic Acid Ethyl POSS (TSAE POSS) |

R = ethyl

TABLE 1-continued

| POSS Chemical Structures | |
|---|---|
| POSS Chemical Structure | Chemical Name |
| 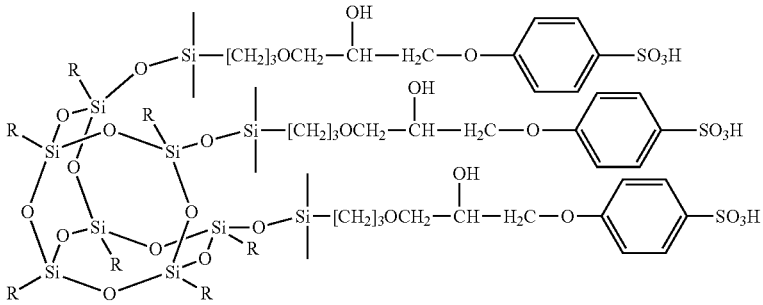 R = isobuty | Tris Sulfonic Acid Isobutyl POSS (TSAiB POSS) |

In the two-component fluids, the suspensions contain greater than 1% (v/v) and preferably 5% or more (v/v) of the cage compound, such as a sulfonated silsesquioxane cage compound or a polyhedral oligomeric silsesquioxane. Generally, the fluids contain less than or equal to 30% (v/v) or less than or equal to 20% (v/v). In one embodiment, the two-component fluids contain 5-10% (v/v) of the cage compound.

The Polymeric Material

Three-component fluids contain a polymeric material that has been found to enhance the ER effect of fluids containing the other two components. By using the polymeric material, fluids can be formulated that have a much greater change of viscosity upon application of an electric field than the two-component fluids. Alternatively or in addition, the increased effectiveness of the three-component fluid containing the polymeric material allows formulation of the fluid using a lower level of the amphiphile or cage compound. This is advantageous not least because a relatively expensive material can be replaced with a polymeric material (such as polystyrene) that is much less expensive.

In one embodiment, the polymeric material is polystyrene. Other materials that enhance the ER effect in a similar way include polyaniline and sulfonated polystyrene. In various embodiments, suitable polymeric materials can be empirically identified by determining their ability to enhance the ER effect when formulated into fluids.

The polymeric material is normally provided in the form of a powder consisting of particle of polymers. The particles range in diameter for 50 nm to about 500 micrometers. In various embodiments, the particles have diameter of 1-500 micrometers, 3-100 micrometers, or 5-50 micrometers.

The polymeric material is incorporated in the three-component fluids at a level sufficient to bring about the desired enhancement of the ER effect. Normally at least 1% and preferably at least 5% (in the alternative either by weight or by volume) is required to show an effect. Although a level above 10% or 20% is not normally required, the polymeric material can be present even at a level of up to 50%, especially in the case where the amphiphile such as a sulfonated polyhedral oligomeric silsesquioxane is present at high levels such as those above 3% or so. In this paragraph, the considerations apply to percentages by weight as well as volume to volume (v/v).

The ER fluids of the invention are sometimes designated as two-component or three-component fluids to reflect the presence of the oil, the amphiphile (or cage compound, silsesquioxane, etc.) and (as a third component) the polymeric material. In some embodiments, those are the only components of the fluid, so that the percentages of the components adds to 100. In other embodiments, the fluids can contain amounts of other components that do not interfere unacceptably with the use of the fluids as ER fluids. As such, inventive fluids are those that contain only the stated two or three components, and also those fluids that are open to (normally small) amounts of other components.

Other Considerations

In various embodiments, electrorheological POSS systems are provided. These POSS/polydimethylsiloxane (PDMS) mixtures provide similar properties to other commercial electrorheological fluids under electric fields, except with much smaller loadings (i.e., concentration of POSS). Some of the POSS materials that give very strong electrorheological effects are sulfonated POSS, which consist of a hydrophilic (acid/ionic) head and a hydrocarbon (carbon chain) tail connected to an open POSS cage. These POSS include tris sulfonic acid ethyl POSS in polydimethylsiloxane and tris sulfonic acid isobutyl POSS in polydimethylsiloxane suspensions. Other less ER active materials from POSS are also provided. These include octa amic acid POSS and PSS-(3-tosyloxypropyl)-heptaisobutyl substituted POSS, which are also provided in suspension form. Another material includes octa (sulfonic acid) POSS, which attaches the acid to the closed POSS cage. These POSS structures include sulfonated POSS structures and an organic acid, which can provide a weaker effect.

Electrorheologically activated systems are provided. These include a polar molecule substituted POSS that provides a high molecular dipole moment to molecular diameter ratio, while maintaining a larger molecular diameter than other polar molecule (PM)-ER fluids. The larger molecules are achieved not only by using polar molecules attached as ligands, but also by affecting the architecture or arrangement of the polar molecules in order to enhance the dipole moment. For example, polystyrene suspensions typically show no change in their rheological behavior under an electric field. However, adding a small amount (~1%) of tris sulfonic acid isobutyl POSS, the suspension displays a strong ER effect. Enhanced electrorheological effects using relatively inexpensive organic materials (e.g., polystyrene) and a small amount of POSS makes these systems suitable for many industrial applications.

Amphiphile polyhedral oligomeric silsesquioxane (POSS)/poly dimethyl siloxane (PDMS) suspensions are shown to exhibit electrorheological behavior despite the fact that the POSS cage structures are electrorheologically inactive. Tris Sulfonic Acid Ethyl (TSAE)-POSS/PDMS is shown to be electrorheologically active. The electrorheological yield stresses, rheological behavior in the off-state, dielectric behavior, and short-circuit currents in Tris Sulfonic Acid Isobutyl (TSAiB)-POSS and Tosyloxypropyl Heptaisobutyl (Tosyl)-POSS and TSAE POSS/PDMS suspensions are examined. TSAiB POSS exhibited a strong electrorheological effect and a large stress peak. Tosyl POSS/PDMS possesses a comparatively weak dielectric relaxation and exhibited the weakest ER effect. On the other hand, TSAE POSS/PDMS suspensions possess the highest yield stresses of the Amphiphile silsesquioxane suspensions. In principle, this ER behavior in these systems results from the synergy between the ER inactive nanocages and the functionalized organic groups attached to them. Inactive nanocage materials (POSS) comprise a new class of electrorheological behavior.

In various embodiments, electrorheological fluids are provided that include functionalized polyhedral silsesquioxanes (POSS) in silicone oil; specifically Tris sulfonic acid ethyl POSS (TSAE POSS); see FIG. 1. The sPOSS/PDMS mixtures possess viscosities comparable to the pure silicone oil, yet experience an increase of the viscosity by a factor of $1\times10^2$, with only 7 wt. % sulfonated POSS molecules, for E=2 kV/mm. By contrast, isotropic octa-isobutyl POSS particles exhibited virtually no electrorheological behavior, even at 10% wt and under a 2 kV/mm field, which indicates that the POSS based systems may not be generally, not ER active, as discussed below.

Due in a large part to the GER effect, a renewed interest exists in formulating the optimum ER (or GER) fluid. Evidently, organic functional molecules when appropriately processed with high permittivity inorganic materials can exhibit significant ER behavior. Researchers have focused on high permittivity inorganic nanoparticles (ferroelectrics or titania) in order to take advantage of high local electric fields, fast polarization and simple polarization theory which suggest these materials should give the largest stresses, which were not seen experimentally in conventional (micron sized) ER fluids. The reason for low ER activity in micron sized ferroelectric materials was shown by Hao to result from interparticle repulsive forces under electric fields inhibiting interfacial polarization at the surface boundaries, but allowing the materials to polarize quickly in the bulk; this prevents orientation and column formation in DC fields (24—Hao, T.; Kawai, A.; Ikazaki, F. *Langmuir* 2000, 16 (7), 3058-3066).

However, reducing the size of these materials enhances the local electric fields between nanoparticles and increases the dipole strength of the nanoparticles; this leads to significant increases in the ER stresses. Inorganic materials that are often examined in electrorheology that are an exception to this are zeolites. Zeolites possess comparatively low dipole strengths yet exhibit very large ER effects due to the high level of mobile charge carriers, cations, which facilitates strong interfacial polarization at the surfaces (25-Filisko, F.; Radzilowski; L.; *J. Rheol.* 1990, 34(4), 539-552). Organic electrorheological materials, in contrast, possess reasonable particle conductivities ($10^{-7}$-$10^{-5}$ S/m), due to either electronic (e.g. in the case of conjugated organics) or ionic (e.g. in the case of functionalized polymers) conductivities (8—Akhavan, J. *Proc. IMechE, Part G: J. Aero. Eng.* 2006, 221 (4), 577-587.)

The hybridized core shell composites, prepared through the integration of high relative permittivity inorganic nanoparticles with functional organic molecules exhibit the GER effect.

As described herein, we showed that mixtures of sulfonated polyhedral silsesquioxane cage structures (sPOSS) and poly (dimethyl siloxane) (PDMS), silicone oil, exhibit significant electrorheological (ER) activity. In principle, this behavior results from the synergy between the ER inactive nanocages and the functionalized organic groups attached to them. Here, three different Amphiphile POSS molecules are mixed with polydimethylsiloxane to create a series of suspensions. The Amphiphile POSS systems each exhibited an ER effect. The strongest ER effect was for TSAE POSS/PDMS suspensions, which was investigated in further detail than had been in the previous publication. The weakest ER effect was for Tosyl POSS with only one functional group attached. These results suggest that the functional groups are responsible for the ER effect, not the nanocage. The nanocage however is necessary to facilitate the formation of a structure needed to transfer and to sustain the stresses.

EXAMPLE 1

Experimental

Rheological, dielectric, and conductivity measurements were performed on TSAE-POSS/silicone oil and octa-isobutyl POSS/silicone oil mixtures. The POSS molecules were purchased from Hybrid Plastics and the polydimethylsiloxane from Sigma-Aldrich. The POSS concentrations in the suspensions varied from 2-10 wt. %. The dielectric measurements for the suspensions were performed using a dielectric spectrometer (Novocontrol GmbH) in the frequency range between 1 Hz and 1.0 MHz and at temperature T=25° C. The rheological measurements were performed using the TA Instruments ARES Rheometer, attached to a high voltage generator. Prior to performing the measurements, all the samples were sheared at high shear rates in the absence of an electric field in order to ensure homogeneity. Step rate and shear rate tests were performed using parallel plate (50 mm diameter plates) geometries. In order to ensure consistency in the measurements, the shear rate sweeps were taken first at high frequencies and subsequently performed at progressively lower frequencies.

Results and Discussion—Two Component Fluids

Figures 2A, 2B:
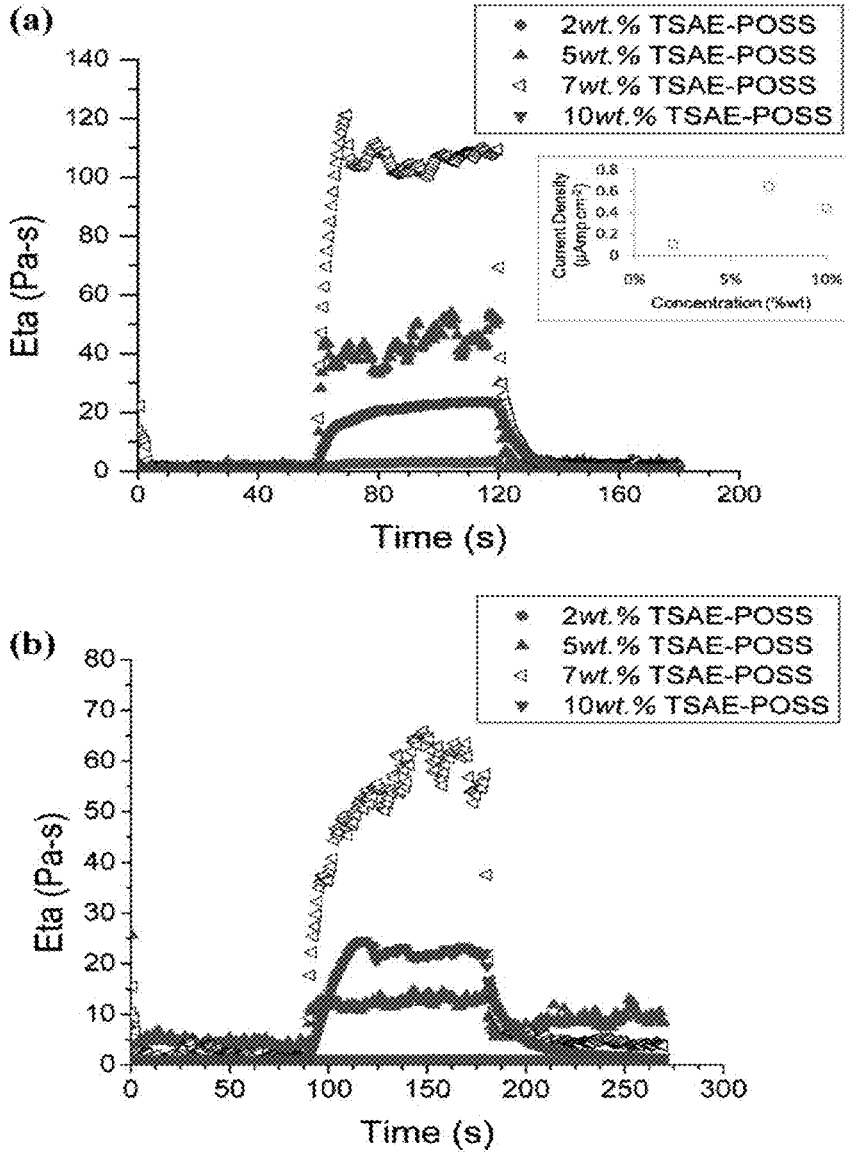
Figure 2C:
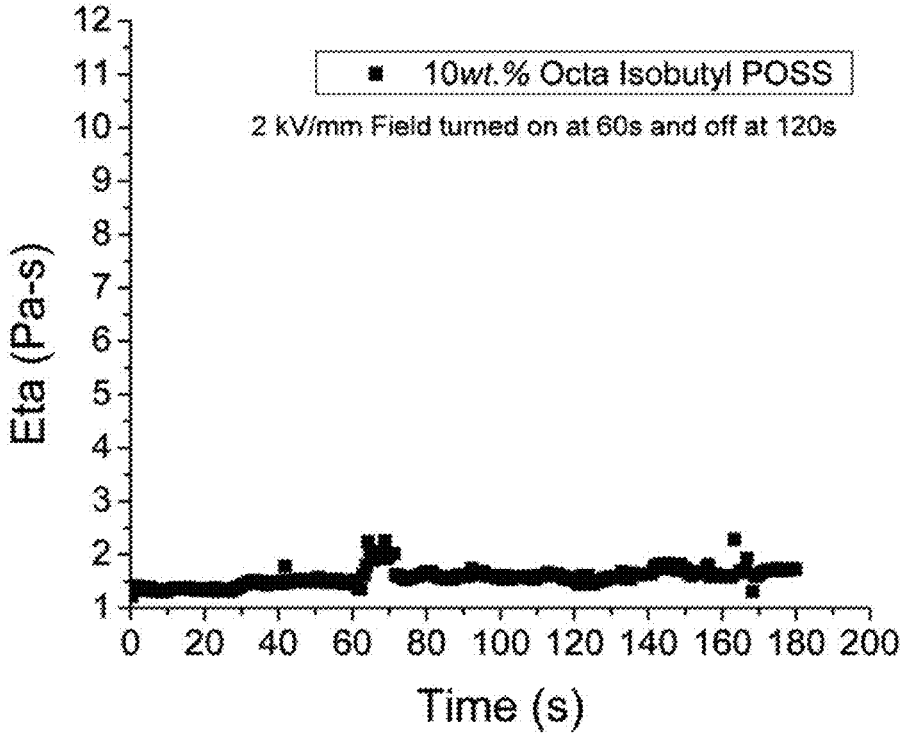

The ER response, apparent viscosities, η, obtained using constant shear rate experiments, of the sulfonated TSAE POSS/silicone oil system are shown in FIG. 2*a*. Upon application of a DC field, η increases with increasing TSAE-POSS concentration by just over a factor of 100 for mixtures containing 7 wt. %; η decreases for higher concentrations. It returns to its original value upon removal of the field. It is noteworthy that the magnitude of the increase of the viscosity at 7 wt % is comparable to that exhibited by conventional ER fluids, for comparable E-fields. The degree of packing and orientation of the molecules along the field influences the magnitude of the ER effect. Interestingly, the time-scale of the increase, seconds, is comparable to the time associated with column formation in conventional particle/oil ER fluid suspensions, despite the size of the molecules and the steric effects. The viscosities exhibited the same qualitative trends under the influence of AC fields, as they did under conditions of DC fields. The magnitude of the effect is necessarily smaller, under AC conditions. The data in FIG. 2*c* illustrate the behavior of octa-isobutyl POSS in silicone oil; it exhibited virtually no ER response even at 10% wt under 2 kV/mm electric field. This observation supports the notion that the effect is not ubiquitous in POSS based systems.

To gain some insight into the response of these POSS systems dielectric spectroscopy studies were performed. The complex permittivities and the conductivities of the suspensions increase with increasing concentration, as shown in FIG. 3. For systems that possess high dielectric constants, particle polarization would be enhanced; this would lead to strong and stable meso-structure formation in the oil, spanning the electrodes. According to one assessment, particle dielectric constants should be at least four times that of the matrix fluid. The data in FIG. 3 show that the TSAE-POSS mixture meets this criterion. Additionally, in order to achieve a strong positive electrorheological effect, the dielectric loss should be greater that 0.1. Finally, the dielectric relaxation should fall between $1\times10^2$ and $1\times10^5$ Hz, as observed. We note that the octa-isobutyl POSS/silicone system is not dielectrically active, so it is not entirely surprising that it does not exhibit an ER effect. The presence of the sulfonated groups are evidently responsible for the dipolar behavior, and hence the ER response of the TSAE-POSS system.

The data in FIGS. 2*a* and 2*b* indicate that for concentrations beyond 7 wt. %, the ER effect diminishes. On the other hand, the dielectric spectroscopy data indicate that the dielectric strength increases monotonically with concentration. We also measured the current densities (leakage current), which become finite when the meso-structures span the electrodes, leading to the ER effect. The magnitudes of the current densities are comparable to, though slightly smaller, those measured in conventional ER fluids. More important, the current densities are comparable in magnitude across the composition range. This indicates that the decrease of the ER effect for the 10% sample is not associated with a change in current densities. The decreased ER effect, beyond 7 wt. %, may be associated with the inability (steric effects) of the dipoles to align within the field on sufficient time-scales during which the experiment is performed. Measurements of the shear-rate dependence of the effect under different fields support this notion.

The data in FIG. 4 shows the response (stress) versus shear rate behaviors of TSAE-POSS at 10% wt., at different field strengths. In the absence of the E-field, the behavior for the TSAE-POSS suspensions is Newtonian (FIG. 4). As shown in FIG. 5, the electrorheological response of the TSAE POSS system increases linearly with increasing field, under conditions of low shear rates, 0.1/sec. Note that at small TSAE-POSS concentrations, 2%, the ER effect is weak, and the dependence of the stress on the field is weaker than E, which may not be unexpected, because there are insufficient POSS molecules in the system to form a viable structure that spans the electrodes.

A simple way of understanding the power law dependence on the E-field in conventional ER fluids is that the induced polarization, P (number of dipoles per unit volume), is proportional to the applied field E, hence the force $F\approx PE\approx E^2$. Notably the shear stresses of the TSAE-POSS/PDMS system exhibited a linear dependence on E. The linear dependence is readily reconciled with the fact that the functionalized POSS molecules possess permanent dipole moments. Consequently the force between the molecules aligned between the electrodes is proportional to PE, where P, which we presume is the saturation polarization, is a constant, independent of E.

Consequently the stress is proportional to the field, $$\tau\approx\phi\eta(E)f(m)E$$

The response of the materials should scale approximately as the volume fraction, $\phi$, the number of particles per unit volume, $\eta(E)$, aligned with the field between the electrodes and a function of an effective dipole moment, $f$ of the system.

Conclusions

A new electrorheological system of sulfonated POSS particles in silicone oil has been identified and investigated. The stresses, $\tau$, reflecting the response of the mixture, are comparable to the stresses exhibited by conventional ER fluids, under the influence of comparable applied electric fields, $E\approx1$ kV/mm, at low POSS concentrations. A number of soft matter systems, polyelectrolyte/oil, polymer liquid crystal, and conjugated polymer/oil systems, where the polymer phase is able to form an extended structure, exhibit ER behavior. This linear E-field dependence is based on the notion that these POSS molecules possess permanent dipole moments and the shear stress between the electrodes is proportional to PE.

EXAMPLE 2

Materials and Methods

Preparation of POSS Suspensions (ER Fluids)

The polyhedral silsesquioxanes; purchased from Hybrid Plastics, and used in our experiments were Tris sulfonic acid ethyl POSS (TSAE POSS) and tris sulfonic acid isobutyl POSS (TSAiB POSS). Tosyloxypropyl heptaisobutyl POSS (Tosyl POSS) was purchased from Sigma Aldrich. While Tosyl POSS was in powder form, TSAE POSS and TSAiB POSS were highly viscous liquids that formed particulate suspensions upon the addition of silicone oil. The densities of the POSS from the manufacturer ranged between 1.0-1.2 g $cm^{-3}$. The dispersing oil, polydimethyl siloxane (PDMS) used was purchased from Sigma Aldrich and possesses a viscosity of 1 Pa·s. Prior to use the particles were dried at 80° C. under vacuum for three hours. This temperature was chosen because TSAE and TSAiB POSS were found to be thermally unstable at temperatures above 100° C., based on measurements with the TGA. PDMS was heated above 130° C. and placed over molecular sieves for drying overnight in order to remove moisture, prior to use. The concentrations of the suspensions that were prepared varied from 2-10% by weight.

The rheological measurements were performed using the TA Instruments ARES Rheometer, attached to a high voltage generator. Prior to performing the measurements, all the samples were sheared at high shear rates in the absence of an electric field in order to ensure homogeneity. Transient step rate (constant shear rate) and steady shear rate tests were performed using parallel plate (50 mm diameter plates) geometries. To ensure consistency in the rate sweep measurements, we first took the shear rate sweeps at high frequencies and subsequently performed them at progressively lower frequencies. The dielectric measurements of the suspensions were performed using a dielectric spectrometer (Novocontrol GmbH) in the frequency range between 1 Hz and 1.0 MHz and at temperature 25° C. The experimental results are described in the following section.

Results and Discussion

The data in FIG. 6 reveal that amphiphile POSS/PDMS systems are electrorheologically active; when sheared between parallel plates, rotated at a constant velocity, these systems exhibit an increase in the shear stress by over a factor of 10, under electric fields (FIG. 6). In FIG. 6 the maximum shear stresses, $\tau_{max}$, are shown for the different ER fluids, due to the presence of the electric field and in the absence of the electric field, for a constant shear rate. The third sample in our study, Tosyl POSS/PDMS, exhibited fluctuating shear stresses in the absence of the applied electric field. The increase in the shear stress for these suspensions is believed to be due to the structuring of POSS molecules that form organized columnar meso-scale structures that span the distance between the electrodes under the influence of the electric field, as shown in FIG. 7.

TSAE POSS/PDMS and TSAiB POSS/PDMS suspensions possess low viscosities, comparable to conventional ER fluids, in the off-state. TSAiB POSS/PDMS systems exhibit Newtonian off-state behavior, as shown by the data FIG. 8, where the stress varies linearly with the shear rate. On the other hand, the viscosity of TSAE POSS/PDMS mixture increases at low shear rates (<1.0 $s^{-1}$); at high shear rates it becomes Newtonian. Tosyl POSS/PDMS possesses a higher viscosity than TSAE and TSAiB POSS in the off-state. This increase in viscosity in the absence of an electric field at low shear rates for TSAE POSS and at all shear rates for Tosyl POSS is believed to be due to local aggregation of the POSS molecules, which has been seen in other nanoparticle based suspensions.

Figure 7C:
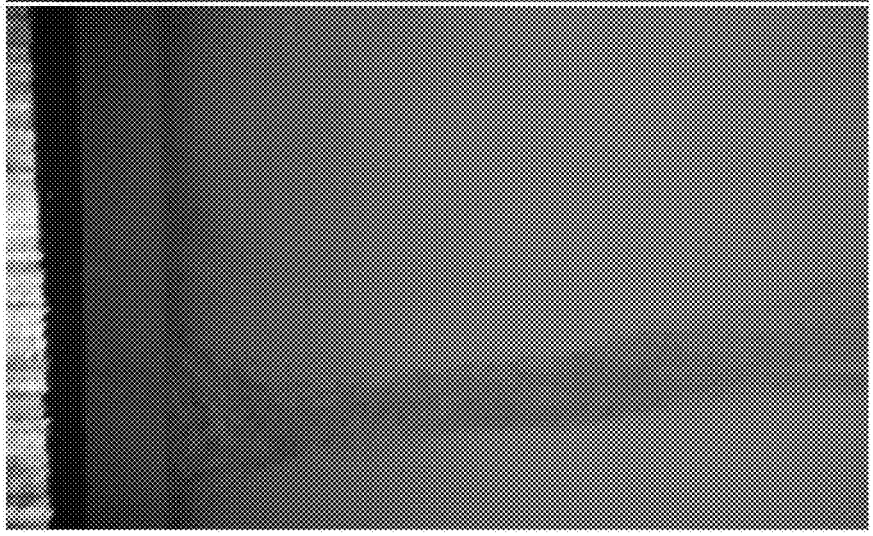

The effect of the electric field is to increase the shear stresses sustainable by the Amphiphile POSS suspensions, as shown in FIG. 8. Under the electric field the POSS meso-structures form and span the electrodes (FIG. 7*c*). Shearing the ER fluid breaks up these structures and may induce slippage at the surface of the electrode. Yielding of the amphiphile POSS electrorheological structures occurs when the stress exceeds the electrostatic forces responsible for sustaining the meso-structure. Below the critical shear stress the ER fluid behaves like a viscoelastic solid. The deformation of an ER structure is characterized by three regimes: pre-yield, yield and post-yield regimes. In the pre-yield region the field induced structures that sustain the stress; fluid does not flow. In the post-yield region, the shear stress reaches a critical value; consequently the field induced structures fail and the ER fluid flows.

Two models that have been used successfully to describe yielding in ER fluids are the Bingham model and the Herschel-Bulkley model. In the Bingham model the fluid under shear behaves like a rigid body at stresses below the yield stress and flows with a constant plastic viscosity for applied shear stress above the yield stress. By comparing the shear stress vs. shear rate data for a fluid and performing a least squares fit to the Bingham model, an approximate yield stress can be obtained. The Bingham model predicts that the measured shear stress:

$$\tau_B=\tau_y+\eta d\gamma/dt \quad [3]$$

where $\tau_y$ is the dynamic yield stress and $\eta$ is the plastic viscosity and $d\gamma/dt$ is the shear rate. While the simplest equation for determining the yield stress in an ER fluid is the Bingham equation, the Bingham equation, like many other yield stress models, only captures limited information about the pre-yield and post-yield responses of the fluid. For example Bingham fluid pre-yield behavior ($\tau<\tau_y$) shows no deformation (rigid body). However, this is not true for ER fluids.

The Herschel-Bulkley model provides a more accurate measure of the dynamic yield stress (strength) of the structures in the suspension. In this model a third parameter, which describes the flow index, n, provides a better description of the behavior of the fluid above the yield stress. It predicts that:

$$\tau_{H\text{-}B}=\tau_0+k(d\gamma/dt)^n \quad [4]$$

where $\tau_0$ is the dynamic yield stress and k is the consistency.

The information in Table 2 was determined from an analysis of the data in FIG. 8 using equation 4. The dynamic yield stresses, $\tau_0$, of the amphiphile POSS suspensions provided the most information about the meso-structures since the yield stresses indicate the level of stress at which the electrostatic forces responsible for sustaining the structures are overcome. TSAE POSS/PDMS suspensions possess much larger yield stress behavior than either TSAiB or Tosyl POSS suspensions. The yield stresses for TSAE POSS at a lower electric field were nearly an order of magnitude greater than either Tosyl or TSAiB POSS. This is unexpected given the similarity in the chemical structures of both TSAE and TSAiB POSS. The shape of the TSAiB data under electric field shows a maximum in the stress occurring which is absent for the TSAE POSS data, which may be responsible for the lower yield stress behavior.

The post-yield behavior for each of the amphiphile suspensions is given by the consistency index k and the flow index n*, which are related to the magnitude of the viscosity and the rate at which the viscosity changes with shear rate, respectively. The consistencies of the amphiphile suspensions are all similar, as is evident from the data in Table 2. The flow index is very different for each suspension. A lower flow index indicates that the suspension flows more easily in response to an increasing shear rate or that the shear thinning characteristics of the suspension are increased. TSAiB POSS/PDMS has a flow index close to 1 and does not show strong shear thinning. Tosyl POSS/PDMS and TSAE POSS/PDMS both demonstrate shear thinning under the electric field. This is the result of the POSS or meso-structures aligning with the shear flow creating a reduction in the suspension viscosity at increasing shear rates.

TABLE 2

Herschel Bulkley Parameters for FIG. 2 Amphiphile Suspensions

| | Electric Field E | Dynamic Yield Stress □$_0$ | Consistency K | Flow Index n |
|---|---|---|---|---|
| 10% wt. Tosyl POSS/PDMS | 2.0 kV/mm | 1.1 Pa | 14.8 Pa s | 0.65 |
| 10% wt. TSAiB POSS/PDMS | 2.0 kV/mm | 3.6 Pa | 17.4 Pa s | 0.95 |
| 10% wt. TSAE POSS/PDMS | 1.5 kV/mm | 22.9 Pa | 13.2 Pa s | 0.40 |

In FIG. 8, TSAiB POSS/PDMS displays a sharp increase in the stress in the postyield region, which cannot be modeled using the Herschel-Bulkley model. The Herschel-Bulkley parameters from equation 4 for the preyield and postyield behavior of these suspensions do not give any indication as to the yielding mechanism or other complicated phenomena in the suspension that may occur. The peak in the stress develops during shearing of the suspension in the electric field. Rearrangement in ER structures from "column-like" structures spanning the electrodes to lamellar structures has been demonstrated in several ER fluids. Because the rearrangement requires both electrostatic forces (high fields) and hydrodynamic forces (shearing) it has been suggested that due to the thermodynamics the lamellar structures spontaneously form, driven by a lowering of the free energy in the system.

Spontaneous lamellar rearrangement from "column-like" structures in ER fluids, may lead to transient stress behavior. The initial "column-like" meso-structure is seen in FIG. 7 for TSAiB POSS/PDMS; evidence for the lamellar rearrangement is seen in the rheogram stress peaks in FIGS. 8 and 9. In order to confirm that the maximum in the stress in TSAiB POSS/PDMS was not due to the POSS aggregates needing more time to align under static conditions, an additional test allowing substantial time (~150 s) with an applied field under static conditions prior to shearing was done. The maximum in stress still occurred during the longer test (not shown). In FIG. 8 for TSAiB POSS/PDMS the shear stress increases under electric field due to ER effect, which suggests that the POSS aggregates are already aligned at the start of the test. Finally, FIG. 9 provides the time for the maximum in stress to occur with the shortest time for the maximum in stress occurring after 10 minutes (600 s) from the start of shearing under the electric field. This supports that the maximum in stress is not due to the POSS aggregates needing more time for alignment under the electric field, but is due to the interactions between the hydrodynamic forces (shearing) and the electrostatic forces (electric field) acting on TSAIB POSS aggregates in the suspension.

The evidence in the preceding paragraph supports that TSAiB POSS/PDMS suspensions during the initial stages of shearing under electric field rearrange from static aligned POSS aggregates into another dynamic structure, possibly lamellar, that increases the stress. In FIG. 9 the meso-structures under shear rearrange into dynamic structures with increasing strength until the ER fluid reaches a maximum shear stress. The shear rate at which the rearrangement occurs is a strong function of concentration (FIG. 9). Higher concentrations of TSAiB POSS in suspensions led to stronger ER structures under electric field, which were able to withstand higher shear rates. The relationship between the process of lamellar formation and the polarization processes responsible for column formation (time) vs. the magnitude of the deformations—strains ($\gamma$)—and shear rates ($d\gamma/dt$) has not yet been understood well in conventional or nanoparticle based ER fluids, but the times and shear rates for the maximum stresses are included in FIG. 9.

The TSAiB POSS particles showed no aggregation effects compared to other amphiphile suspensions without an electric field, and showed strong rearrangement under electric field (FIGS. 8, 9). The maximum in shear stress was exhibited only by TSAiB POSS/PDMS suspensions. Based on these observations, arguably, the driving forces for particle aggregation in the amphiphile suspensions may suppress or prevent the lowering of the free energy required for lamellar or dynamic structure formation seen for TSAiB POSS within the TSAE POSS suspensions. The data suggests that rearrangement in the suspension under electric field is not simply a particle size effect, which could be implied for a driving force leading to particle aggregation. Rather it is believed to be a consequence of the amphiphile nature of the POSS molecules.

Figure 10A:
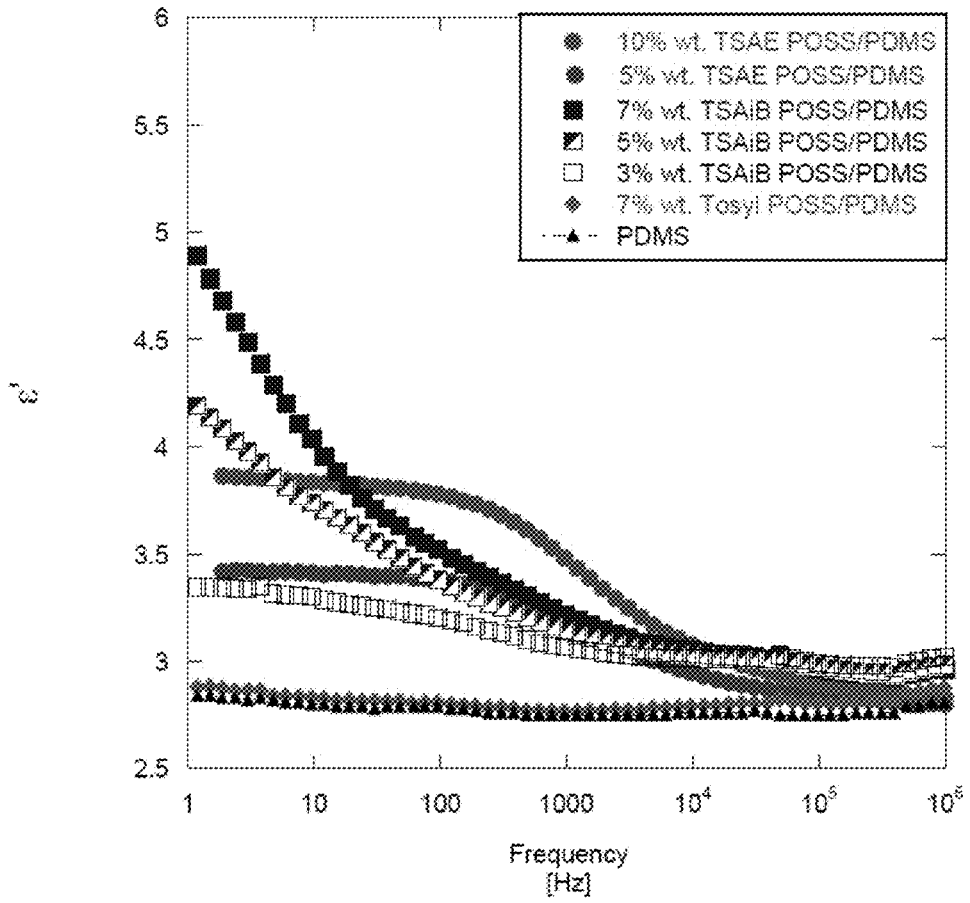
Figure 10B:
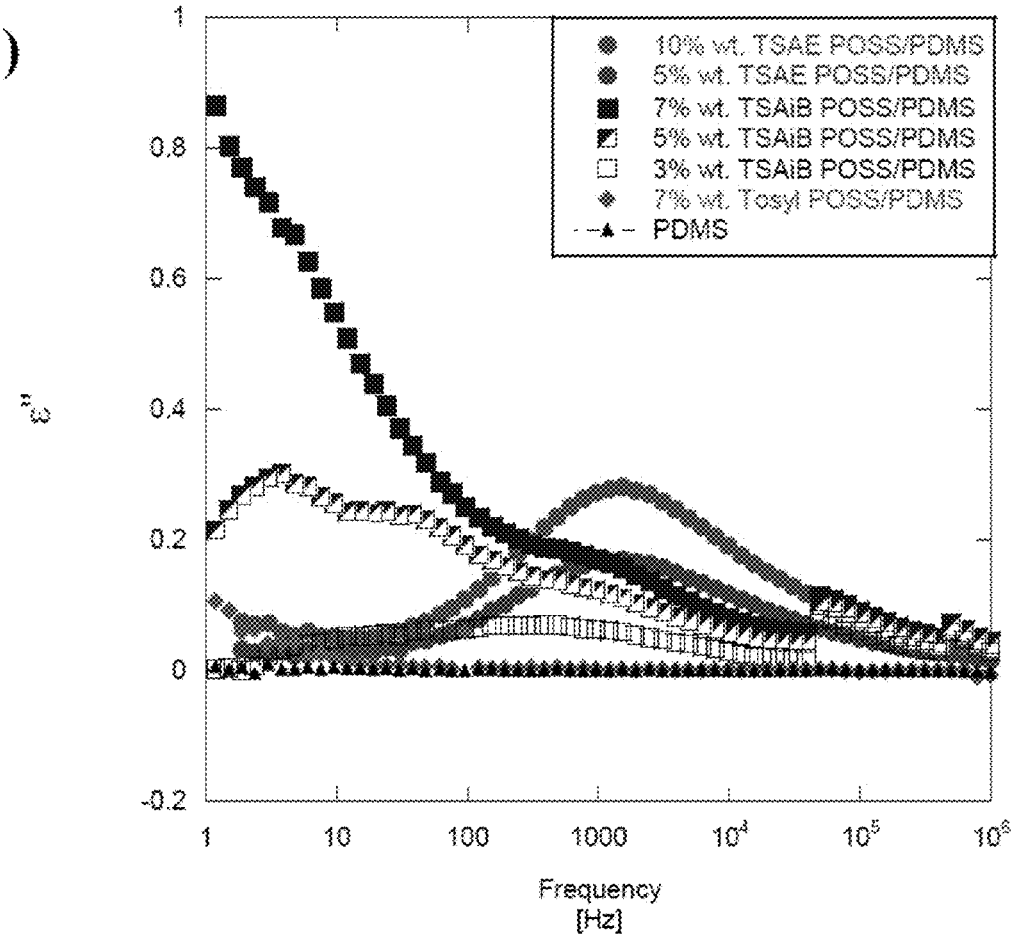

The dielectric properties of the amphiphile POSS suspensions reveal information about the electrorheological behavior because a correlation exists between the dielectric properties of the suspension and the polarization processes that are understood to dominate ER fluids. TSAiB POSS and TSAE POSS suspensions demonstrate strong dipolar relaxations (FIG. 10*a*). The complex permittivities and conductivities increase with increasing concentration for these two systems. Interfacial polarization within the suspension, the proposed mechanism responsible for ER effects, requires dipolar relaxations in these two suspensions that are slow and fall between $1\times10^2$ and $1\times10^5$ Hz. The data in FIG. 10*a* shows that TSAE POSS suspensions meet this empirical criterion. The relaxations for TSAiB POSS are slower, resulting in longer times for polarization processes, which could lead to particle rearrangement processes that were globally slower.

For particle structure formation under electric fields the POSS particle dielectric constants should be at least four times that of the matrix fluid. The data in FIG. 10 reveal then TSAiB POSS/PDMS and TSAE POSS/PDMS meet these criteria. Finally the maximum of the dielectric loss should be greater than 0.1 (FIG. 10*b*). 7% wt. Tosyl POSS/PDMS did not meet any of these criteria for structure formation resulting in a strong positive electrorheological effect. The dielectric properties of the amphiphile POSS suspensions demonstrate strong ER characteristics for TSAE and TSAiB POSS/PDMS suspensions, but weak or no ER effect is likely for Tosyl POSS/PDMS suspensions. TSAE POSS/PDMS exhibits a strong polarization unlike Tosyl POSS/PDMS, and the polarization for TSAE POSS/PDMS is faster than TSAiB POSS/PDMS, which suggests that the ER effect would be stronger. Within the concentrations tested, TSAE POSS/PDMS should give the strongest yield stresses (Table 2), which are related to the strengths of the electrostatic interactions in the meso-structures.

The behavior of the TSAE POSS/PDMS system is now discussed in further detail with a focus on the higher yield stress values. Experiments in which the samples were subjected to shear strains in the presence of electric fields were performed. Specifically, the TSAE POSS/PDMS samples are sheared at a constant rate of 0.5 $s^{-1}$ (measured at the edge of the plates) throughout the entire experiment. After 60 seconds of shearing (FIG. 6), an electric field of E=2 kV/mm is applied, during which the resistance to flow of the suspension (apparent viscosity $\eta=\tau/(d\gamma/dt)$, where $d\gamma/dt$ is the shear rate) is measured. The change of the apparent viscosity, before and after the electric field is applied, provides a measure of the ER effect. When the field was applied to the electrorheological fluid, the POSS particles in the suspension become polarized and form a long-range structure, spanning the electrodes, leading to the "solid-like" behavior observed. The tendency for structure formation is disrupted by forces due to shear-induced flow.

Additional evidence of structure formation due to the electric field is based on the current measured under constant shear rate conditions. The inset in FIG. 11 for the TSAE POSS ER fluid shows that as the concentration of particles in the suspension increases the current also increases. This increase of the current is due to the increase of the number of particles that contribute toward formation of the structures that span the gap. If the current is too high this results in a decrease in the electric field.

The data in FIG. 11 indicate that the 7% wt. TSAE POSS sample exhibits the largest maximum shear stress, $\tau_{max}$; the 10% wt. sample exhibits a smaller $\tau_{max}$. The decrease in shear stress for the 10% wt. TSAE POSS sample is associated with the fact that the structures in the 7% wt. sample form rapidly in comparison to the 10% wt. sample and not due to behavior unique to this system. The drop in stress for 10% wt. TSAE POSS/PDMS was seen previously and could not be resolved by permittivity measurements. The lower stresses for 10% wt. were confirmed with additional testing. The lowest current result is shown in FIG. 6 for 10% wt. TSAE POSS, which gave the highest stress at that concentration and still falls below 7% wt. TSAE POSS. The 10% also recovers slower than the 7%, which supports slower meso-structure formation (FIG. 11 circled portion).

FIG. 12 *a-c* show the effect of concentration for TSAE POSS/PDMS on the formation of meso-structures under electric field by measuring the current density at varying shear rates. At low shear rates where the structures are fully formed the current is highest. The current also increases as the electric field increases for all TSAE/PDMS suspensions. At high shear rates the shearing disrupts the structures and the current drops exponentially as the shear rate is increased for each suspension that was tested.

The process and qualitative kinetics of meso-structure formation is shown in FIG. 12 for the 7% wt. and 10% wt. TSAE POSS/PDMS systems. For a constant shear rate test, the 7% wt. structures form more rapidly and exhibits higher stress behavior than the 10% wt. structures (FIG. 11). The steady rate sweep experiment for TSAE POSS/PDMS further demonstrates the ability for 7% to develop higher current densities, which is associated with faster complete structure formation than the 10 wt. % samples for each electric field tested. From 0.5-1.5 kV/mm the 7% wt develops a stronger current density than the 10% as the shear rate is decreased. FIG. 12 *a-c* shows that for 7% the currents are greater than 10% for lower shear rates.

The evidence for structure formation in FIG. 12 may be seen from the following. At the highest shear rates where the suspensions can be assumed to be roughly uniformly dispersed the current density increases with increasing concentration. The hydrodynamic forces (shearing) are so large that the electrostatic forces necessary for structure formation which would increase the current density are overcome. Because the suspension is randomly dispersed, increasing the volume fraction of the conductive filler (Amphiphile POSS) in the suspension causes the current to increase. As the shear rate decreases the hydrodynamic forces diminish allowing for the meso-structures to span the electrodes and the currents increase until 7% passes 10%. The test demonstrates the crossover point (circled) moves from right to left as the field is decreased. This result implies increasing the electric field results in shorter times for full ER structure formation for 7%, and that the structuring process for 7% relative to 10% proceeds more quickly as the electric field is increased.

Finally it should be pointed out that despite the fact that structure formation proceeds more rapidly for the 7 wt. % TSAE POSS/PDMS suspension, the dynamic yield stresses, which were calculated for these experiments, demonstrate that the 10 wt. % suspension sustained a much higher yield stress than the 7 wt. % suspension. This result agrees with the constant shear rate stresses being an effect of the kinetics of the TSAE POSS/PDMS structuring under the electric field. Table 3 further demonstrates that by using the dynamic yield stress, the more accurate measure of strength of the particle structures, there was an increase in the yield stress with concentration at each electric field.

TABLE 3

Herschel Bulkley Fit Showing Dynamic Yield Stresses at Different Fields

| Electric Field | 0.5 kV/mm $\tau_y$= | 1.0 kV/mm $\tau_y$= | 1.5 kV/mm $\tau_y$= |
|---|---|---|---|
| 2% wt. TSAE POSS | 0.0 Pa | 0.0 Pa | 0.15 Pa |
| 7% wt. TSAE POSS | 1.2 Pa | 2.1 Pa | 1.4 Pa |
| 10% wt. TSAE POSS | 8.2 Pa | 27.5 Pa | 22.9 Pa |

Conclusions

As described herein, we showed that the TSAE-POSS suspension was electrorheologically active; it was proposed that the ER activity was due to the sulfonation of the POSS. We now also show that the amphiphile POSS particle structures formed under electric field show electrorheological activity. Through an investigation of the rheology, dielectric properties of the suspensions and the current behavior the electrorheological properties of amphiphile POSS suspensions were evaluated. TSAiB POSS/PDMS suspensions did not show effects of aggregation in the off state even at very low shear rates. TSAiB POSS demonstrated a strong electrorheological effect. TSAiB POSS also exhibited a stress peak believed to be due to lamellar or dynamic structure formation. The TSAiB POSS maximum in the stress compared to the TSAE POSS is either due to the slow polarization processes within the TSAiB POSS/PDMS suspension demonstrated in the dielectric analysis of its polarization behavior, or that aggregation in the TSAE POSS/PDMS in the off-state prevents lamellar formation in the on-state as a result of the amphiphile nature of the POSS. Tosyl POSS did not display a strong dielectric relaxation and demonstrated the weakest ER activity. Thus, only the two highly sulfonated POSS particles demonstrated strong dipolar relaxation.

This demonstrates that the drop in stress for the TSAE POSS/PDMS at 10% wt. for the constant shear rate test did not correspond to a drop in the dynamic yield stress of the suspension. Furthermore, the cause of the stress drop was proposed to be due to a kinetic effect in the structuring process of the amphiphile POSS suspensions. TSAE POSS/PDMS suspensions possess the best ER properties of the amphiphile silsesquioxane suspensions that demonstrated ER behavior.

EXAMPLE 3

An important challenge in the field of electrorheology is identifying low viscosity fluids that would exhibit significant changes in viscosity, or a yield stress, upon the application of an external electric field. Recent research showed that optimal compositions of mixtures, 10% wt. sulfonated polyhedral oligomeric silsesquioxanes (s-POSS) mixed with polydimethyl siloxane (PDMS), exhibited significant electrorheological activity. Here we show that s-POSS/PDMS mixtures containing polystyrene (PS) fillers, of micron-sized dimensions, containing as little as ~1 wt. % s-POSS, exhibited an increase in ER activity by an order of magnitude, beyond that of s-POSS/PDMS mixtures. The dynamic yield stress was found to scale with the particle diameter, $\alpha$, as $\tau_y \propto \alpha^{0.5}$ and with the electric field as $\tau_y \propto E^{1.5\text{-}2.0}$; this behavior is reasonably well understood within the context of dielectric electrorheological theory.

Electrorheological fluids (ERFs) are suspensions whose mechanical properties become solid-like in the presence of an externally applied electric field.[1-3] The particles in the suspension, initially randomly dispersed, self-organize to form columnar structures that span the electrodes, parallel to the direction of the applied field. These meso-scale structures are responsible for the increase in the resistance to flow and the associated increases in the apparent viscosity, $\eta_{app}$, and the yield stress, $\tau_y$. Upon removal of the external field, the structures collapse and the suspension reverts back to its original state of a suspension with randomly dispersed particles.

Diverse particle suspension systems exhibit electrorheological behavior. A suspension of silica particles and poly dimethyl siloxane (PDMS) constitute one class of ER fluids whose behavior, columnar structure formation and associated enhancement of mechanical properties, is due to an electric field-induced silica particle polarization effect; the yield stress is known to depend on the external field such that $\tau_y \propto E^{2.1\text{-}3}$ In a different class of suspensions, containing particles that possess permanent dipole moments, the dipoles orient along the direction of the applied field and the $\tau_y \propto E$. Electrorheological suspensions containing high concentrations of particles, such as urea[4], citric acid[5], 4-hydroxybutyric acid lactone,[6] and acetic acid,[5] that possess permanent dipoles are of great current interest; they exhibit yield stresses approximately 2 orders of magnitude larger than conventional ER fluids that contain only dielectric (silica) particles. The use of additives to enhance the ER effect in suspensions is well-known, with publications dating back to the 1980s.[7,8] Recently it was demonstrated that high stresses (~200 kPa) could be achieved with large concentrations of micron sized strontium titanium oxalate dielectric particles, in silicone oil, in the presence of water as a polar additive[9]. Electrolytes, acids, bases and surfactants have previously been used as additives to enhance electrorheological behavior.[10]

We recently showed that a new class of materials, PDMS mixed with a caged compound, sulfonated polyhedral oligomeric silsesquioxane (s-POSS), exhibited strong ER behavior.[11] The effect was largest in mixtures containing ~10 wt. % s-POSS. In this paper we show that s-POSS/PDMS mixtures containing only ~1 wt. % POSS, and PS weight fractions ranging from 10 wt. % to 20 wt. %, exhibit increases in viscosity of two orders of magnitude, with the application of an external electric field. This effect is approximately an order of magnitude larger than that of the s-POSS/PDMS system. The dynamic yield stress was found to scale with the particle diameter, $\alpha$, as $\tau_y \propto \alpha^{0.5}$ and with the electric field as $\tau_y \propto E^{1.5-2.0}$. We suggest that this enhancement in the magnitude of the ER activity is due to significant dipolar activity associated with preferential adsorption of the s-POSS molecules onto the surfaces of the polystyrene fillers. This new system has two advantages over current ER systems. Since PS is a commodity polymer the cost of processing large quantities of an ER fluid based on this system is minimized. Our findings also show that the magnitude of the effect scales as the average diameter of the fillers, and suggests that would, in principle, be possible to achieve yield stresses greater than 10 kPa, without the drawbacks of high suspension concentrations, costly nanofabrication procedures and high off-state viscosities.

Experimental

Rheological and dielectric measurements were performed on Tris Sulfonic Acid Isobutyl (TSAiB) POSS/polystyrene/silicone oil. The POSS molecules were purchased from Hybrid Plastics, the monodisperse polystyrene powders were purchased from Polymer Source; the polystyrene microspheres were purchased from Polysciences and the polydimethylsiloxane (PDMS) silicone oil from Sigma-Aldrich. The mixtures were prepared by drying both the POSS and polystyrene at 80° C. under vacuum for at least 3 hours prior to adding the silicone oil which was dried at 150° C. and placed over molecular sieves. The ER fluid formulations and abbreviations are shown in Table 4 below.

TABLE 4

Abbreviations for mixtures of POSS/PS/PDMS

| Abbrev. | Polystyrene[a] <a> = 5.1 μm | Polystyrene <a> = 8.9 μm | Polystyrene <a> = 41.2 μm | Polystyrene Microspheres a = 50 μm | TSAiB POSS | PDMS |
|---|---|---|---|---|---|---|
| s-POSS/PDMS | 0% | 0% | 0% | 0% | 10% | 90% |
| s-POSS/PS/PDMS | 0% | 10% | 0% | 0% | 1% | 89% |
| $PS_1$ | 10% | 0% | 0% | 0% | 1% | 89% |
| $PS_2$ | 0% | 10% | 0% | 0% | 1% | 89% |
| $PS_3$[b] | 0% | 0% | 10% | 0% | 1% | 89% |
| PS100 | 0% | 0% | 0% | 10% | 1% | 89% |

[a]Average Particle Size (radius = <a>)

[b]Polystyrene for $PS_3$ was used with different compositions in FIG. 17

The dielectric measurements of the suspensions were performed using a dielectric spectrometer (Novocontrol GmbH). The liquid suspension cell used in our experiments contained two metal electrodes, connected by Teflon. Data extracted from measurements of an empty cell were used as base-line, i.e.: these data were subtracted from measurements of the fluids. All measurements were performed in the frequency range between 0.1 Hz and 1.0 MHz, at temperature of T=25° C.

The shear stress-strain rate and apparent viscosity-shear stress measurements were performed with a strain-controlled rheometer (TA Instruments ARES). The measurements were performed using 50 mm diameter parallel plate geometries. The shear rates in steady rate sweep tests spanned from 0.1 $s^{-1}$ to 30 The plates were attached to a DC high voltage generator (Trek Model 609 E-6) connected to a 5 MHz function generator (BK Precision 4011A) that allowed for electric fields up to 4 kV/mm. Prior to performing the measurements, all the samples were sheared at high shear rates in the absence of an electric field in order to ensure homogeneity. To ensure consistency in the measurements and in order to prevent stiction[12] we first took the shear rate sweeps at high frequencies and subsequently performed them at progressively lower frequencies.

The particle size distributions (PSD) were determined using the ImageJ software to analyze optical microscopy images of the particles. Because the particles were irregularly shaped, we used the Heywood diameter, the diameter of a circle possessing the same area of the approximately elliptical polystyrene particle, to calculate the mean particle diameter of polystyrene powders. Roughly 20 micrographs were analyzed from each PS powder, at appropriate magnifications. A potential drawback to the use of microscopic methods of particle size comparison is that the lowest number of counts is obtained for the largest particle diameter ($PS_3$) leading to a broader distribution. To overcome this, in addition to the PSD the average diameters were included. Additionally, scanning electron microscopy measurements of the sizes and morphologies of polystyrene solid particles were performed.

Results and Discussion

Figure 13:
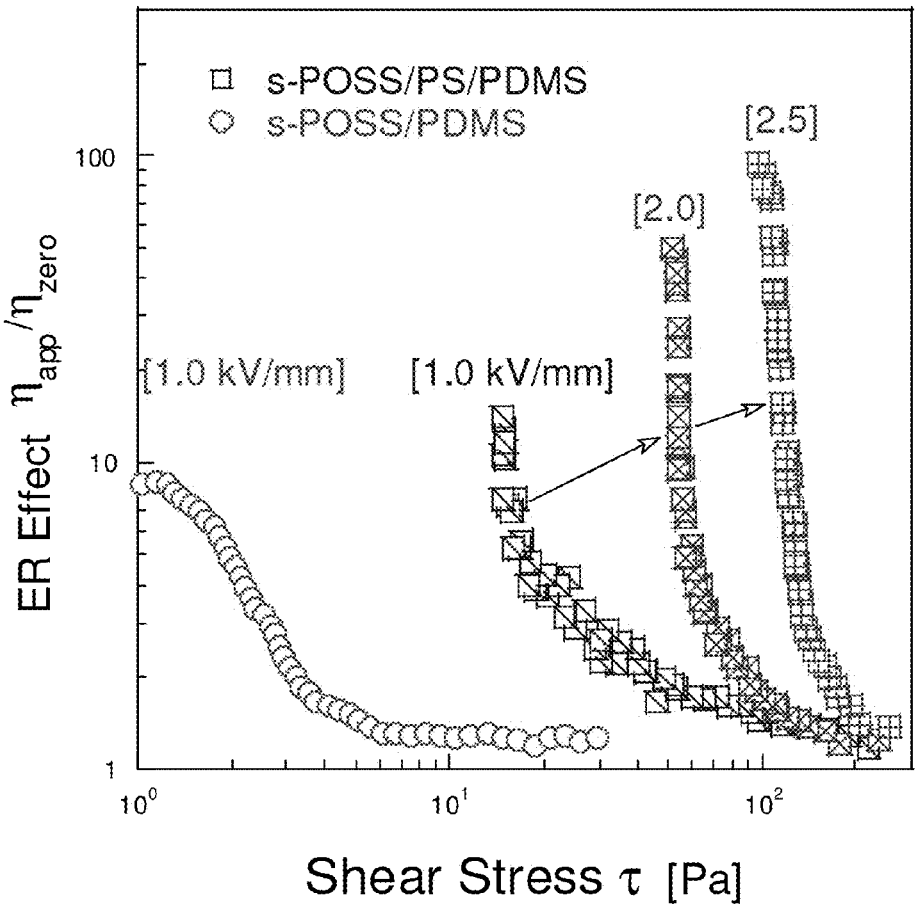

It is evident from the data in FIG. 13 that the ER effect exhibited by the mixture containing polystyrene (PS/s-POSS/PDMS) is appreciably greater than that of the s-POSS/PDMS mixture. The yield stress, estimated from the point on the stress axis at which the curve begins to ascend, is approximately an order of magnitude larger. For the s-POSS/PDMS mixture this stress is less than $\tau_y$~10 Pa, whereas for the PS/s-POSS/PDMS system the stress occurs at approximately $\tau_y$~30 Pa. Additionally, experiments in our lab indicate that the reliability of the PS/s-POSS/PDMS is much better; the s-POSS/PDMS with higher concentrations of s-POSS overheats in DC electric fields of 2 kV/mm and higher.

The dependencies of the shear stress on the shear rate for mixtures, each with 1% wt. TSAiB-POSS, containing PS fillers of different sizes, labeled $PS_1$, $PS_2$ and $PS_3$, under an electric field are shown in FIG. 14. The magnitude of the effect increased with increasing average PS filler size; the $PS_3$ system, containing the largest PS fillers, exhibited the largest ER effect.

An understanding of how the size of the dispersed solids affects the magnitude of the ER effect is of practical significance. A long standing problem in electrorheology has been to understand how the size of the solid particles in suspension affects the polarization properties and ultimately the mechanical behavior of these systems.[4,13-15] The size of the particles in suspension has been shown to affect the magnitude of the yield stress for an ER fluid under an electric field. Table 5 shows theoretical predictions for the dependence of the yield stress, $\tau_y$, on the solid particle radius, $\alpha$, and basic assumptions on which these predictions are based.

It is evident from Table 5 that the magnitude of the ER effect may be tailored through, control of the particle size. It is known that in conventional ER fluids, which contain dielectric particles, increasing the particle size leads to increases in the yield stress; upper limits of $\tau_y$~10 kPa, may be achieved through increases in particle size.[16] The primary limitation of this effect is that beyond a critical particle size, sedimentation occurs; this leads to diminishing ER behavior. With regard to suspensions that contain particles (of sizes less than 0.5 microns) that possess permanent dipole moments, the ER effect increases with decreasing particle size. Yield stresses possessing an upper limit of $\tau_y$~30 MPa can theoretically achieved.[17,18]

TABLE 5

Size Effects in Electrorheological Models

| Model/Theory | Basic Assumptions/ Approximations | Perm. Dipole | $\tau_y = f(a)$ |
|---|---|---|---|
| ELECTROSTATIC MODEL[3, 19] | Point Dipole Approximation | No | $\tau_y \propto a^2$ |
| DIELECTRIC THEORY[16] | $\left(\frac{\varepsilon_p}{\varepsilon_f} \to \infty\right)$ | No | $\tau_{y,max} \propto \sqrt{\frac{a}{\delta}}$ |
| SIMULATION[20] | Single Component Identical Spherical Particles | No | $\tau_y \propto a^3$ |
| FINITE ELEMENT MODELS[14] | Aligned Dipole Layers; Hertz Model | Yes | $\tau_y \propto a^{-1}$ |

a = Solid Particle Radius

The shear stresses are plotted as a function of shear rate in FIG. 14 for suspensions containing PS fillers of three very different average sizes: ~5 μm ($PS_1$), ~9 μm ($PS_2$) and ~40 μm ($PS_3$). The SEM images of the polystyrene fillers are shown in the inset in FIG. 16. It is noteworthy from the data in FIG. 14 that in the absence of the E-field, adding the POSS electrolyte had only a nominal effect the mechanical behavior for the suspensions containing smallest particle sizes. The effect is significant for the suspensions containing the larger fillers. In Derjaguin-Landau-Verwey-Overbeek (DLVO) theory, the electrostatic repulsion is responsible for the energy barrier that keeps particles separated. Adding an electrolyte to a suspension would have the effect of screening the electrostatic repulsion. When the electrostatic repulsion barrier is sufficiently lowered (screened), the solid particles in suspension are free to approach each other, resulting in aggregation (flocculation). A flocculated suspension may exhibit a yield stress, which has its origins in the Van Der Waals attractions between the solid particles. This yield stress, due to flocculation, exists even in the absence of the applied electric field. The data in FIG. 15 reveal that in the absence of an applied field, the yield stress is comparable with or without the addition of POSS.

Figure 16:
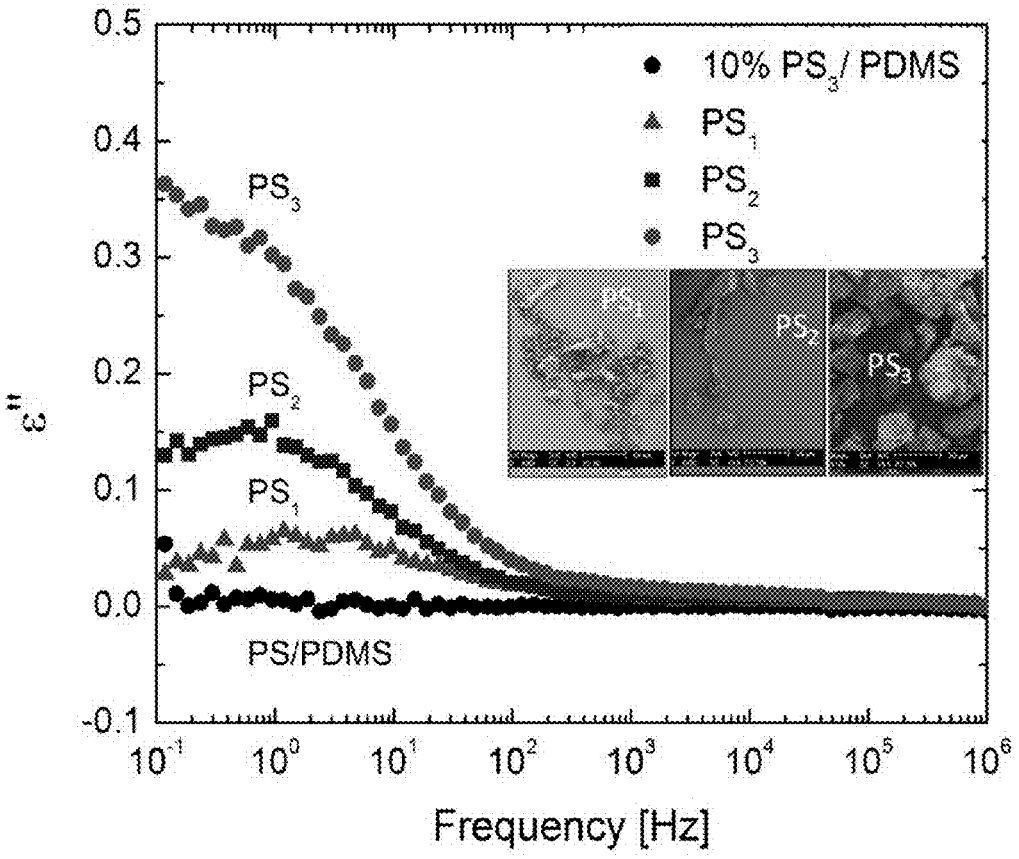

To gain further insight into the differences in the magnitudes of the suspensions containing the PS fillers of different sizes, the dielectric properties was measured. Of particular interest is the low frequency relaxation process, which manifests the polarization in the PS/s-POSS/PDMS system due to the permittivity mismatch across the PS/PDMS interfaces. The connection between the low frequency relaxation and the ER effect is that the ER effect is controlled by slow (<$10^5$ Hz) polarization processes.[21] As shown in FIGS. 15 and 16, of the real $\in'$ and imaginary $\in''$ parts of the relative permittivity, the two component PS/PDMS mixture is dielectrically inactive. The data in FIG. 15 show that at low frequencies, $PS_3$ exhibited the highest permittivity, followed by $PS_2$ and $PS_1$. The incremental dielectric quantities of the suspension increase with increasing average filler size. More precisely, the height of the curve, or $\Delta\in$, reflects the size of the induced dipole moment.[22,23] the relative dielectric properties of the three different size polystyrene electrorheological suspensions, plotted in FIG. 15, are consistent with the magnitudes of the stresses plotted in FIG. 14.

The consistency of the connection between the dielectric activity and the average particle sizes appears to be independent of the polydispersity in the sizes and significant irregularity in their shapes.

We note moreover that the effect of the size of the polystyrene fillers is consistent with the behavior of the conventional ER size effect, i.e.: suspensions containing dielectric particles. It is, however, not consistent with that of ER suspensions containing particles with permanent dipoles (see Table 5). Increasing the average PS filler size leads to enhancements of the ER effect. Sulfonic acids, which are present in TSAiB POSS, possess a strong dipole moment. Therefore, the conventional ER size effect is unexpected, since TSAiB POSS, due to the attached sulfonic acids, likely possesses a strong permanent dipole moment.

In the foregoing, we have clearly shown that adding polystyrene to the s-POSS/PDMS suspension has the effect of increasing the ER effect by over an order of magnitude. Determination of the concentration of polystyrene at which the largest yield stress is achieved requires evaluating the effects of the relative concentrations of the POSS electrolyte and polystyrene within the suspension. In order to quantify the effects of composition on the yielding behavior, the Ellis Model, modified by Barnes will be employed.[24] The model suggests that the apparent viscosity ($\eta_{app}=\tau_{Stress}/[d\gamma/dt]_{Strain\ Rate}$) decreases from a large asymptotic value, $\eta_0$, to a low viscosity, $\eta_\infty$.

$$\frac{\eta_{app}-\eta_\infty}{\eta_0-\eta_\infty} = \frac{1}{1+(\tau/\tau_c)^m} \tag{4}$$

The transition is denoted by a critical stress, $\tau_{0c}$, at which shear thinning occurs; the magnitude exponent m, used as a fitting parameter, is sensitive to the sharpness of the transition between the two viscosities. Large values of m are associated with increasingly sharp yielding transitions; the largest values of m are associated with "extreme' shear thinning. The physical mechanism for the yield stress of the suspension would be due to the formation of a solid-like network structure that sustains the stresses within the fluid. The suspension reverts to its liquid-like state when the stress is transferred from its solid-like network structure to the surrounding fluid. This point is referred to as the critical stress or yield stress. At higher stresses the fluid flows with a reduced apparent viscosity, $\eta_\infty$. Because the system of interest in our study exhibits a change in viscosity in response to an external field, it is useful to use the Ellis model instead of other models, such as a Bingham model. The Bingham model considers the behavior of a system with an infinite viscosity, at stresses below the yield stress ($\tau<\tau_y$), and a Newtonian viscosity at stresses $\tau>\tau_y$. The Bingham model was useful for understanding the behavior of our system (see supplemental information).

Shown in FIG. 17 are a series of plots of the apparent viscosity as a function of shear stress, for various compositions of PS and s-POSS of the fluid. The Ellis model is used to describe the data for each composition; the fitting parameters are identified with each plot. First consider the bottom row in that figure; the magnitude of the effect increases with decreasing PS weight fraction, while the s-POSS remains constant at 0.5. wt. %. The largest effect, largest m and a two-order of magnitude change in the viscosity, is exhibited by the samples: PS(20%)/s-POSS(3%), PS(15%)/s-POSS(2%) and PS(10%)/s-POSS(1%). The magnitude of the effects exhibited by PS(20%)/s-POSS(1%) and PS(10%)/s-POSS(0.5%) are comparable. These data indicate the existence of an optimal composition which exhibits the largest effect: large ratio of PS to s-POSS, and a maximum amount of PS. This ratio would be consistent with the preferential segregation of the s-POSS to the interface between the PS fillers and PDMS. The formation of a structure composed of the PS fillers that span the electrodes would be responsible for sustaining the stress. Therefore sufficient s-POSS would have to be available to segregate form interfacial layers on all the filler particles. This of course would be accomplished with a small fraction of s-POSS. Additionally there should a sufficient fraction of filler particles to create structures, spanning the electrodes, of sufficient mechanical integrity. This will be determined by an optimal particle size and particle volume fraction. We examine this thesis in further detail below.

The magnitude of the ER effect exhibited by a 2-component fluid is influenced by the spatial distribution of a third component within the mixture.[26] With regard to our system, two extreme cases might be relevant. For Case 1 the s-POSS is located (dispersed and aggregated) entirely within the carrier fluid (FIG. 18). For Case 2 the s-POSS forms an interfacial layer between the PS and the PDMS. Excess fluid would form a separate phase. To determine the location of s-POSS additives within suspensions we examined a model system, monodisperse spherical polystyrene particles mixed with s-POSS/PDMS. Optical images of polystyrene microspheres in a s-POSS/PS/PDMS suspension reveal that the s-POSS coats, and induces aggregation of PS spheres in the PS/s-POSS/PDMS system. Notably, these PS microspheres do not aggregate in PDMS.

That POSS coats the surface of the polystyrene is not unexpected. To begin with, PS and PDMS are immiscible and the interfacial tension between them is large 6.1 $mJ/m^2$ for 150° C.[27]. We note further that the interfacial tension between PS and poly (methyl methacrylate) (PMMA) at the same temperature is 1.6 $mJ/m^2$, yet it has been shorn that POSS grafts have the effect of reducing the interfacial tension between PS and PMMA to 1.1 $mJ/m^2$; this is due to favorable interactions between the PS and the POSS grafts[28]. The favorable POSS/PS interactions are therefore important for the existence of this effect.

The formally inert filler particles, now coated with dipolar s-POSS molecules, behave as fillers possessing effective dipole moments. We also examined the ER behavior of micron sized model monodisperse spherical PS fillers (Dry form microspheres were used to minimize the effect of water) and also measured an appreciable ER effect.

The presence of adsorbed polar molecules on the PS fillers suggests that the properties of our system would bear similarities to polar molecule (PM) ER fluids. The notable difference, of course, is that the particles in the PM-ER fluids are generally of nanoscale dimensions. For polar molecule dominated ER fluids the yield stress $\tau_y \propto E$. In contrast, for conventional dielectric ER fluids, the yield stress varies as: $\tau_y \propto E^2$). We examined the dependence of the yield stress of the PS/s-POSS/PDMS system on the applied field. In FIG. 19 the data show that the dynamic yield stress increases with increasing PS filler radius. The dynamic yield stress, $\tau_y^d$, was calculated from our data, using the Bingham model. Here the stress, $\tau$, is expressed in terms of the dynamics yield stress, the viscosity, $\eta_p$, and the shear stress: $\tau = \tau_y^d + \eta_p \dot{\gamma}$. The yield stress increases with the radius of polystyrene, for particles of radii of up to 50 microns; $\tau_y$ is proportional to $\alpha^{0.5}$. This trend in fact is consistent with predictions developed for dielectric electrorheological materials (Table 5). The inset of FIG. 19 indicates an electric field dependence of $\tau_y \propto E^{1.5-2.0}$. This too is consistent with the predictions for the yield stress, using conduction theory, for the dielectric ER fluids[29].

Conclusion

We showed that a suspension composed of PDMS, PS fillers and small concentrations, ~1 wt. % s-POSS, exhibited a significant ER effect under the presence of an external field. The viscosity changed by two orders of magnitude with the application of a field. This increase is an order of magnitude larger than that exhibited by that of a 10% wt. s-POSS/90 wt. % PDMS ER mixture. The ER yield stress increased with filler size a such that $\tau_y^d \sim \alpha^{0.5}$, where $\alpha$ is the radius of the microsphere. The effect is independent of the filler size dispersion and shape. This behavior is associated with the interfacial adsorption between the PS surfaces and PDMS environment.

References for Example 3

1. Halsey, T. C. *Science* 1992, 258, (5083), 761-766.
2. Halsey, T. C.; Toor, W. *Phys. Rev. Lett.* 1990, 65, (22), 2820.
3. Parthasarathy, M.; Klingenberg, D. J. *Mater. Sci. Engin. R:* 1995, 17, (2), 57-103.
4. Wen, W.; Huang, X.; Yang, S.; Lu, K.; Sheng, P. *Nat. Mater.* 2003, 2, (11), 727-730.
5. Cheng, Y.; Guo, J.; Liu, X.; Sun, A.; Xu, G.; Cui, P. J. *Mater. Chem.* 2011, 21, 5051-5056.
6. Xu, L.; Tian, W. J.; Wu, X. F.; Cao, J. G.; Zhou, L. W.; Huang, J. P.; Gu, G. Q. J. *Mater. Res.* 2008, 23, 409-417.
7. Deinega, Y. F.; Vinogradov, G. V. *Rheol. Acta* 1984, 23, (6), 636-651.
8. Block, H.; Kelly, J. P. *J. Phys. D: Appl. Phys.* 1988, 21, (12), 1661.
9. Orellana, C. S.; He, J.; Jaeger, H. M. *Soft Matter* 2011.
10. Kim, Y. D.; Klingenberg, D. J. *J. Colloid Interface Sci.* 1996, 183, (2), 568-578.
11. McIntyre, E. C.; Oh, H. J.; Green, P. F. *ACS Appl. Mat. & Interfaces* 2010, 2, (4), 965-968.
12. Weiss, K. D.; Carlson, J. D.; Coulter, J. P. *J. Intel. Mater. Sys. Structures* 1993, 4, (1), 13-34.
13. Cheng, Y.; Guo, J.; Liu, X.; Sun, A.; Xu, G.; Cui, P. *J. Mater. Chem.* 2011, 21, (13), 5051-5056.
14. Wen, W.; Huang, X.; Sheng, P. *Appl. Phys. Lett.* 2004, 85, (2), 299-301.
15. Wu, C. W.; Conrad, H. *J. Appl. Phys* 1998, 83, 3880-3884.
16. Ma, H.; Wen, W.; Tam, W. Y.; Sheng, P. *Adv. Phys.* 2003, 52, (4), 343-383.
17. Chen, S.; Huang, X.; van der Vegt, N. F. A.; Wen, W.; Sheng, P. *Phys. Rev. Lett.* 2010, 105, (4).
18. Chen, S.; Huang, X.; Wen, W.; Sheng, P. *Int. J. Mod. Phys. B* 2011, 25, (7), 897-903.
19. Anderson, R. A. *Langmuir* 1994, 10, (9), 2917-2928.
20. Tan, Z.-J.; Zou, X.-W.; Zhang, W.-B.; Jin, Z.-Z. *Phys. Rev. E* 1999, 59, (3), 3177.
21. Block, H.; Kelly, J. P.; Qin, A.; Watson, T. *Langmuir* 1990, 6, (1), 6-14.
22. Carrique, F.; Arroyo, F. J.; Delgado, A. V. *J. Colloid Interface Sci.* 1998, 206, (2), 569-576.
23. Carrique, F.; Arroyo, F. J.; Jimenez, M. L.; Delgado, A. V. *J. Chem. Phys.* 2003, 118, 1945-1956.
24. Roberts, G. P.; Barnes, H. A.; Carew, P. *Chem. Engin. Sci.* 2001, 56, (19), 5617-5623.
25. Phan-Thien, N.; Gartling, D. K. *J. Non-Newtonian Fluid Mech.* 1984, 14, 347-360.
26. Xiaodong, D.; et al. *J. Phys. D: Appl. Phys.* 2000, 33, (23), 3102.
27. Wu, S., *Polymer interface and adhesion. Marcel Dekker Inc.:* 1982.

28. Zhang, W.; Fu, B. X.; Seo, Y.; Schrag, E.; Hsiao, B.; Mather, P. T.; Yang, N.-L.; Xu, D.; Ade, H.; Rafailovich, M.; Sokolov, J. *Macromolecules* 2002, 35, (21), 8029-8038.
29. Atten, P.; Boissy, C.; Foulc, J. N. *J. Electrosta.* 1997, 40-41, 3-12.
30. Gamota, D. R.; Filisko, F. E. *J. Rheol.* 1991, 35, 399-425.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

The following non-limiting discussion of terminology is provided with respect to the present technology.

The headings (such as "Introduction" and "Summary") and sub-headings used herein are intended only for general organization of topics within the present disclosure, and are not intended to limit the disclosure of the technology or any aspect thereof. In particular, subject matter disclosed in the "Introduction" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The description and specific examples, while indicating embodiments of the technology, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

As used herein, the words "desire" or "desirable" refer to embodiments of the technology that afford certain benefits, under certain circumstances. However, other embodiments may also be desirable, under the same or other circumstances. Furthermore, the recitation of one or more desired embodiments does not imply that other embodiments are not useful, and is not intended to exclude other embodiments from the scope of the technology. As used herein, the word "include," and its variants, is intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components or process steps, the present technology also specifically includes embodiments consisting of, or consisting essentially of, such materials, components or processes excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as temperatures, molecular weights, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

"A" and "an" as used herein indicate "at least one" of the item is present; a plurality of such items may be present, when possible. "About" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

What is claimed is:

1. An electrorheological (ER) fluid comprising a suspension of an amphiphile in an oil, wherein the amphiphile is an amphiphilic polyhedral oligomeric silsesquioxane.

2. An ER fluid according to claim 1, wherein the amphiphile is a sulfonated polyhedral oligomeric silsesquioxane (sPOSS).

3. The ER fluid of claim 2, wherein the sPOSS comprises:

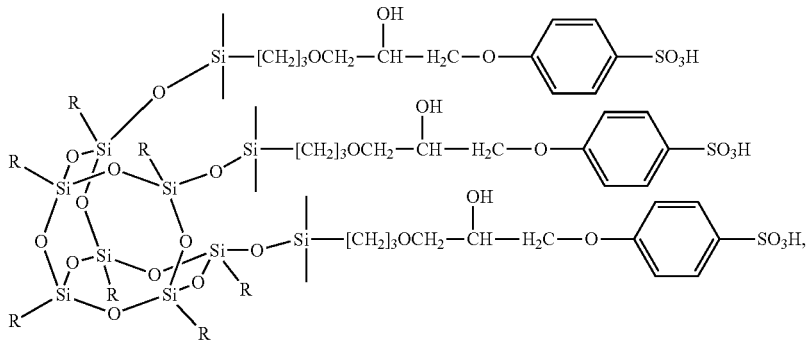

wherein each R is independently an alkyl group.

4. The ER fluid of claim 3, wherein each R is an alkyl group selected from methyl, ethyl, propyl, butyl, and isobutyl.

5. The ER fluid of claim 3, wherein each R is ethyl or each R is isobutyl.

6. The ER fluid of claim 1, wherein the amphiphile is a polyhedral oligomeric silsesquioxane substituted with a single tosyloxypropyl group, with one to eight carboxyl groups, or with one to eight sulfonic acid groups.

7. The ER fluid of claim 1, wherein the oil is a silicone oil, a mineral oil, a paraffin oil, or a viscous hydrocarbon.

8. The ER fluid of claim 7, wherein the oil is polydimethylsiloxane.

9. The ER fluid of claim 1, further comprising suspended particles of an organic polymeric material that enhances the ER properties of the ER fluid.

10. The ER fluid of claim 9, wherein the organic polymeric material comprises polystyrene.

11. The ER fluid of claim 9, wherein the amount of the organic polymeric material in the ER fluid is greater than the amount of the amphiphile.

12. An ER fluid according to claim 9, wherein the amphiphile is a polyhedral oligomeric silsesquioxane substituted with at least one polar group, and wherein the amphiphile as a result of the substitution has a permanent dipole.

13. A method of changing the rheological properties of an ER fluid comprising applying an electric field to an ER fluid according to claim 1.

14. An electrorheological (ER) fluid comprising a suspension of a sulfonated siloxane cage compound in a polydimethylsiloxane oil (PDMS),wherein the suspension comprises greater than 1% (v/v) and less than or equal to 30% (v/v) of the sulfonated silsesquioxane cage compound.

15. An ER fluid according to claim 14, wherein the cage compound is a sulfonated polyhedral oligomeric silsesquioxane.

16. An ER fluid according to claim 15, comprising 5%(v/v) to 20% (v/v) of the sulfonated polyhedral oligomeric silsesquioxane.

17. An ER fluid according to claim 15, comprising 5%(v/v) to 10% (v/v) of the sulfonated polyhedral oligomeric silsesquioxane.

18. An ER fluid according to claim 15, wherein the sulfonated polyhedral oligomeric silsesquioxane is

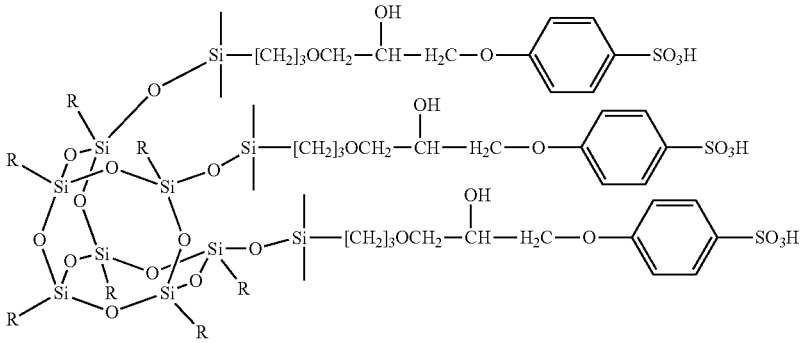

wherein each R is independently an alkyl group.

19. An ER fluid according to claim 18, wherein each R is ethyl or each R is isobutyl.

20. An electrorheological (ER) fluid comprising a suspension of a sulfonated siloxane cage compound and a polymeric material in an oil, wherein the suspension comprises 0.1-10% by weight of the cage compound and 5-50% by weight of the polymeric material.

21. An ER fluid according to claim 20, wherein the oil is selected from mineral oil, paraffin oil, a viscous hydrocarbon, and a silicone oil.

22. An ER fluid according to claim 20, wherein the oil is polydimethylsiloxane.

23. An ER fluid according to claim 20, comprising 0.5-3% by weight of the sulfonated siloxane cage compound and 5-30% by weight of the polymeric material.

24. An ER fluid according to claim 20, wherein the sulfonated siloxane cage compound is a sulfonated polyhedral oligomeric silsesquioxane.

25. An ER fluid according to claim 24, wherein the sulfonated polyhedral oligomeric silsesquioxane is

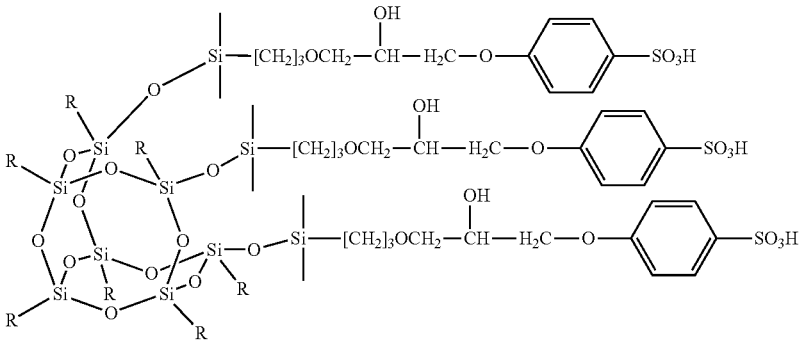

wherein each R is independently selected from C1-C10 alkyl.

26. An ER fluid according to claim 25, wherein each R is independently selected from C1-C4 alkyl.

27. An ER fluid according to claim 25, wherein each R is ethyl, or wherein each R is isobutyl.

28. An ER fluid according to claim 20, wherein the polymeric material comprises polystyrene particles having a diameter of 1-500 micrometers.

29. An ER fluid according to claim 28, wherein the polystyrene particles have a diameter of 5-50 micrometers.

30. An ER fluid according to claim 20, comprising 0.5-3% by weight of a sulfonated polyhedral oligomeric silsesquioxane, 5-20% by weight polystyrene particles having a diameter of 1-100 micrometers, and the balance polydimethylsiloxane.

* * * * *